US010995693B2

(12) United States Patent
Watanabe et al.

(10) Patent No.: US 10,995,693 B2
(45) Date of Patent: May 4, 2021

(54) ENGINE COOLING STRUCTURE

(71) Applicant: Mazda Motor Corporation, Hiroshima (JP)

(72) Inventors: Shinji Watanabe, Hiroshima (JP); Tatsuya Takahata, Hiroshima (JP); Yoshiaki Hayamizu, Higashihiroshima (JP); Keita Watanabe, Hiroshima (JP); Mikimasa Kawaguchi, Higashihiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/738,146

(22) Filed: Jan. 9, 2020

(65) Prior Publication Data

US 2020/0232412 A1 Jul. 23, 2020

(30) Foreign Application Priority Data

Jan. 17, 2019 (JP) ..... JP2019-006066

(51) Int. Cl.
*F02F 1/14* (2006.01)
*F01P 3/02* (2006.01)
(Continued)

(52) U.S. Cl.
CPC ..... *F02F 1/14* (2013.01); *F01P 3/02* (2013.01); *F01P 3/14* (2013.01); *F01P 5/10* (2013.01);
(Continued)

(58) Field of Classification Search
CPC ..... F01P 3/02; F01P 3/14; F01P 5/10; F02F 1/14
See application file for complete search history.

(56) References Cited

U.S. PATENT DOCUMENTS

2015/0345363 A1* 12/2015 Marutani ..... F02F 1/166 123/41.44
2015/0377114 A1 12/2015 Matsumoto et al.
(Continued)

FOREIGN PATENT DOCUMENTS

DE 102015006786 A1 3/2015
DE 112014000928 T5 11/2015
(Continued)

OTHER PUBLICATIONS

European Patent Office, Extended European Search Report Issued in Application No. 20150495.8, dated May 20, 2020, Germany, 8 pages.
(Continued)

*Primary Examiner* — Kevin A Lathers
(74) *Attorney, Agent, or Firm* — Alleman Hall Creasman & Tuttle LLP

(57) ABSTRACT

An engine cooling structure includes a cylinder block including a block inner peripheral wall and a block outer peripheral wall that define a water jacket, and a spacer housed in the water jacket. The block outer peripheral wall includes a coolant inlet for introducing a coolant into the water jacket at one end in a cylinder row direction. The spacer includes a peripheral wall surrounding the block inner peripheral wall, and a dividing wall and a distribution wall provided on the peripheral wall. The dividing wall is provided along a circumferential direction of the peripheral wall and protrudes outward from the peripheral wall between a lower end and an upper end of the coolant inlet. The distribution wall includes an upper distribution wall extending upward from the dividing wall and a lower distribution wall extending downward from the dividing wall.

12 Claims, 19 Drawing Sheets

(51) Int. Cl.

| | |
|---|---|
| ***F01P 3/14*** | (2006.01) |
| ***F01P 5/10*** | (2006.01) |
| ***F01P 11/08*** | (2006.01) |
| ***F01P 3/00*** | (2006.01) |

(52) U.S. Cl.
CPC ..... *F01P 11/08* (2013.01); *F01P 2003/001* (2013.01); *F01P 2003/006* (2013.01); *F01P 2003/021* (2013.01)

(56) References Cited

U.S. PATENT DOCUMENTS

| | | | | |
|---|---|---|---|---|
| 2016/0010533 | A1 | 1/2016 | Matsumoto et al. | |
| 2017/0067411 | A1 | 3/2017 | Doho et al. | |
| 2017/0298858 | A1 | 10/2017 | Mori et al. | |
| 2017/0298860 | A1* | 10/2017 | Mori ..... | F01P 3/02 |
| 2017/0350302 | A1 | 12/2017 | Araki et al. | |

FOREIGN PATENT DOCUMENTS

| | | | |
|---|---|---|---|
| JP | S556433 | U | 1/1980 |
| JP | H07127520 | A | 5/1995 |
| JP | 2015108345 | A | 6/2015 |
| JP | 2015108346 | A | 6/2015 |
| JP | 2015190403 | A | 11/2015 |
| JP | 2016121578 | A | 7/2016 |
| JP | 2018123742 | A | 8/2018 |

OTHER PUBLICATIONS

European Patent Office, Extended European Search Report Issued in Application No. 20150494.1 dated Jun. 16, 2020, Germany, 7 pages.

* cited by examiner

ENGINE COOLING STRUCTURE

CROSS-REFERENCE TO RELATED APPLICATION

This application is based on Japanese Patent application No. 2019-006066 filed in Japan Patent Office on Jan. 17, 2019, the contents of which are hereby incorporated by reference.

TECHNICAL FIELD

The present invention relates to a structure for cooling an engine body including a plurality of cylinders by using a coolant.

BACKGROUND ART

As an engine cooling structure, a structure that cools an engine body by circulating a coolant through a water jacket formed to surround a cylinder wall is known. Another structure is also known in which a spacer surrounding a cylinder wall is housed in a water jacket and a circulation channel for a coolant in the water jacket is separated by the spacer.

For example, Japanese Patent Application Laid-Open No. 2015-190403 discloses a structure in which a spacer is housed in a water jacket and the spacer causes a coolant to circulate only in an upper region of the water jacket. Specifically, Japanese Patent Application Laid-Open No. 2015-190403 discloses an engine in which the spacer is housed in the water jacket, and a coolant-introducing part that introduces the coolant into the water jacket is formed on a cylinder block outer peripheral wall. The spacer includes a spacer upper part close to the cylinder block outer peripheral wall and a spacer lower part close to a cylinder liner. In the spacer upper part, an opening for introducing the coolant introduced from the coolant-introducing part into the inside of the spacer is formed.

With the structure of Japanese Patent Application Laid-Open No. 2015-190403, almost all of the coolant introduced from the coolant-introducing part into the water jacket is introduced into a space between the spacer upper part and the cylinder liner, and almost all of the coolant circulates through the space. Therefore, the upper part of the cylinder liner can be efficiently cooled.

In other words, with the structure of Japanese Patent Application Laid-Open No. 2015-190403, although the coolant flows in the upper region of the water jacket, the coolant hardly flows in the lower region of the water jacket. That is, the lower region of the water jacket is a dead space. Thus, there is a problem that the water jacket is not effectively used.

SUMMARY OF INVENTION

The present invention has been made in view of the above circumstances, and an object of the present invention is to provide an engine cooling structure that can use the water jacket more effectively.

An engine cooling structure according to the present invention for solving the above problem is a structure for cooling an engine body including a plurality of cylinders arranged in a row by using a coolant, and includes: a cylinder block including: a block inner peripheral wall defining the plurality of cylinders; and a block outer peripheral wall surrounding the block inner peripheral wall to define a water jacket through which the coolant circulates between the block outer peripheral wall and the block inner peripheral wall; and a spacer housed in the water jacket. The block outer peripheral wall includes a coolant inlet configured to introduce the coolant from a water pump into the water jacket at one end in a cylinder row direction. The spacer includes: a peripheral wall surrounding the block inner peripheral wall to divide the water jacket into an inner space near the plurality of cylinders and an outer space far from the plurality of cylinders; a dividing wall provided along a circumferential direction of the peripheral wall to divide the peripheral wall into an upper peripheral wall and a lower peripheral wall below the upper peripheral wall; and a distribution wall provided in a part facing the coolant inlet in the peripheral wall in order to distribute the coolant introduced from the coolant inlet into the water jacket to a first side and a second side of the circumferential direction of the peripheral wall, the distribution wall protruding outward from the peripheral wall and extending in an up-and-down direction. The dividing wall includes a part protruding outward from the peripheral wall at a position between a lower end and an upper end of the coolant inlet. The distribution wall includes: an upper distribution wall extending upward from an upper surface of the dividing wall; and a lower distribution wall extending downward from a lower surface of the dividing wall.

DESCRIPTION OF EMBODIMENT

An engine cooling structure according to an embodiment of the present invention will be described below with reference to the drawings.

(1) Overall Configuration

Figure 1:
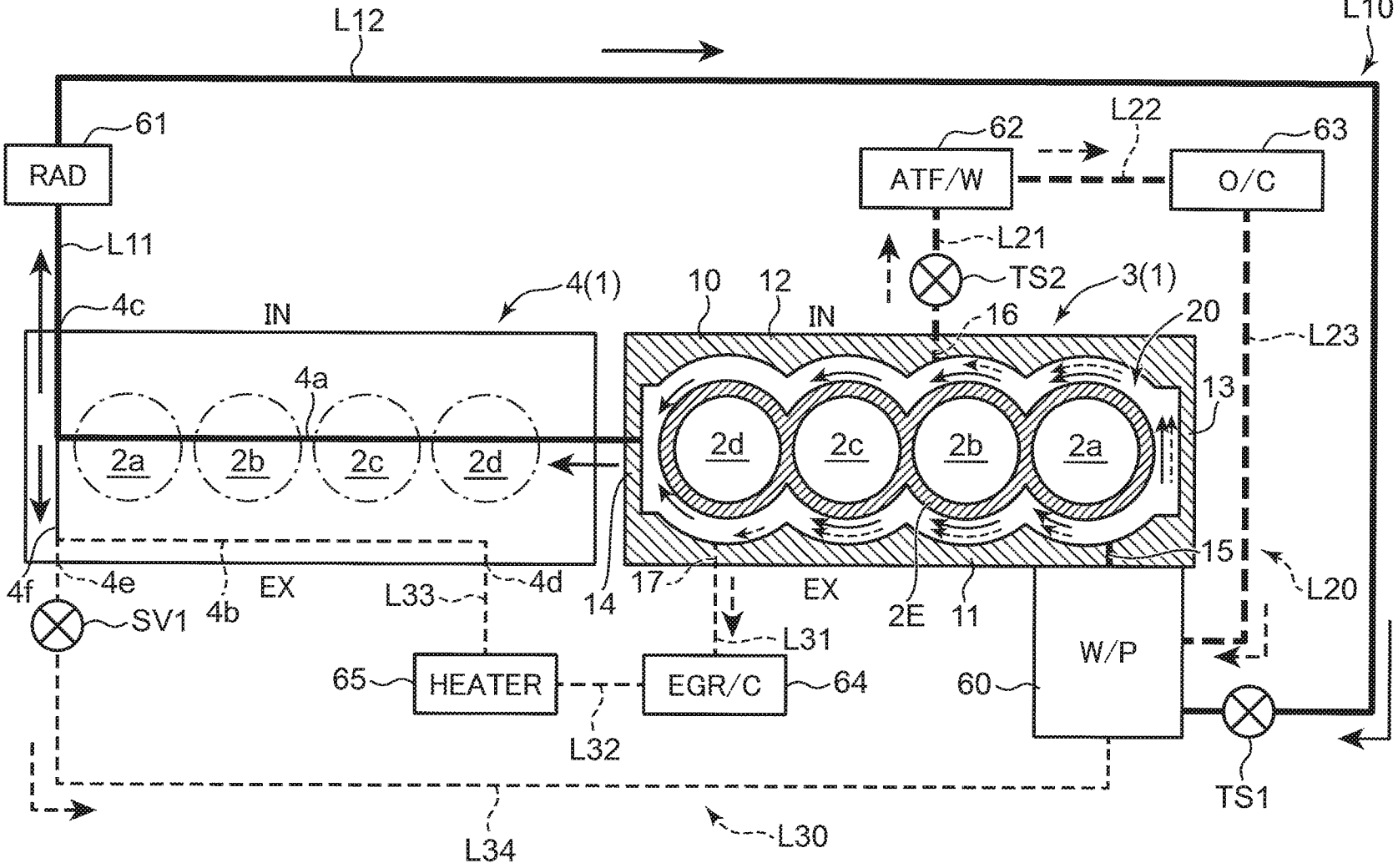
FIG. 1 is a schematic diagram showing an overall configuration of an engine system according to an embodiment of the present invention.

FIG. 1 is a schematic diagram showing a preferred embodiment of an engine system to which the cooling structure of the present invention is applied. An engine system 100 includes an engine body 1, a water pump 60, a radiator (RAD) 61, an automatic transmission fluid warmer (ATF/W) 62, an oil cooler (O/C) 63, an exhaust gas recirculation cooler (EGR/C) 64, and a heater 65. In the present embodiment, the ATF warmer 62, the oil cooler 63, the EGR cooler 64, and the heater 65 correspond to the "heat exchanger" of the claims.

As shown in FIG. 1, the engine body 1 is a series four-cylinder type four-cycle engine including four substantially cylindrical cylinders 2*a* to 2*d* arranged in a predetermined direction. The engine body 1 is mounted on a vehicle as a drive source for rotationally driving wheels. The engine body 1 includes a cylinder block 3 in which the cylinders 2*a* to 2*d* are formed, and a cylinder head 4 fastened to the cylinder block 3 covering a top surface of the cylinder block 3. In each of the cylinders 2*a* to 2*d*, a piston (not shown) is fitted to allow up-and-down reciprocating motion. In each of the cylinders 2*a* to 2*d*, a crown surface of the piston and a bottom surface of the cylinder head 4 define a combustion chamber in which an air-fuel mixture burns. In the engine according to the present embodiment, auto-ignition combustion in which the air-fuel mixture is self-ignited is performed in at least a part of an operation region. Note that FIG. 1 shows the cylinder block 3 and the cylinder head 4 separate from each other.

Hereinafter, the four cylinders 2*a* to 2*d* formed in the cylinder block 3 are referred to as a first cylinder 2*a*, a second cylinder 2*b*, a third cylinder 2*c*, and a fourth cylinder 2*d*, respectively, in order from the right side of FIG. 1. Meanwhile, the first to fourth cylinders 2*a* to 2*d*, when referred to without particular distinction, are simply referred to as cylinders 2. As appropriate, a direction in which the cylinders 2 are arranged, that is, a cylinder row direction is referred to as a front-to-back direction, a direction from the fourth cylinder 2*d* to the first cylinder 2*a* is referred to as forward, and a direction from the first cylinder 2*a* to the fourth cylinder 2*d* is referred to as backward. Note that FIG. 1 shows that the cylinder head 4 is opposite to the cylinder block 3 in a front-to-back direction, and in the cylinder head 4, the fourth cylinder 2*d* is on the right side and the first cylinder 2*a* is on the left side. In the present embodiment, the first cylinder 2*a* and the fourth cylinder 2*d* correspond to the "cylinders at both ends" of the claims, and each of the second cylinder 2*b* and the third cylinder 2*c* corresponds to the "central cylinder" of the claims. The first cylinder 2*a* corresponds to the "first end cylinder" of the claims, and the fourth cylinder 2*d* corresponds to the "second end cylinder" of the claims.

In the cylinder head 4, an intake port (not shown) for introducing intake air into the cylinder 2 and an exhaust port (not shown) for discharging exhaust gas from the cylinder 2 are formed separately on a first side and a second side in a width direction of the engine body 1 orthogonal to the cylinder row direction across a central axis of the cylinder 2. Hereinafter, as appropriate, the width direction of the engine body 1 is referred to as a right-to-left direction, the side on which the intake port is formed is referred to as an intake side or left, and the opposite side is referred to as an exhaust side or right. In FIG. 1 and other figures, "EX" indicates the exhaust side, and "IN" indicates the intake side.

The water pump 60 is a device that discharges a coolant for cooling the engine body 1. A water jacket 20 through which the coolant can circulate is formed in the cylinder block 3. The water pump 60 introduces the coolant into the water jacket 20.

Specifically, the cylinder block 3 includes a block inner peripheral wall 2E that defines the four cylinders 2, and a block outer peripheral wall 10 surrounding the block inner peripheral wall 2E. The water jacket 20 is defined and formed between the block inner peripheral wall 2E and the block outer peripheral wall 10. A coolant-introducing hole 15 is formed in the block outer peripheral wall 10. The coolant-introducing hole 15 opens on an outer peripheral surface of the block outer peripheral wall 10 and communicates with the water jacket 20. The water pump 60 is fixed to the cylinder block 3 in communication with the coolant-introducing hole 15. The coolant discharged from the water pump 60 is introduced into the water jacket 20 via the coolant-introducing hole 15. In the present embodiment, the coolant-introducing hole 15 corresponds to the "coolant inlet" of the claims.

In the block outer peripheral wall 10, a first block side outlet hole 16 and a second block side outlet hole 17 are formed in addition to the coolant-introducing hole 15. Each of the outlet holes 16 and 17 opens on the outer peripheral surface of the block outer peripheral wall 10 and communicates with the water jacket 20. In the present embodiment, the first block side outlet hole 16 and the second block side outlet hole 17 correspond to the "coolant exit" of the claims. The first block side outlet hole 16 corresponds to the "first exit" of the claims, and the second block side outlet hole 17 corresponds to the "second exit" of the claims.

The radiator 61 is a device for cooling the coolant, and cools the coolant circulating inside by a running wind, a cooling fan, or the like of a vehicle.

Figure 2:
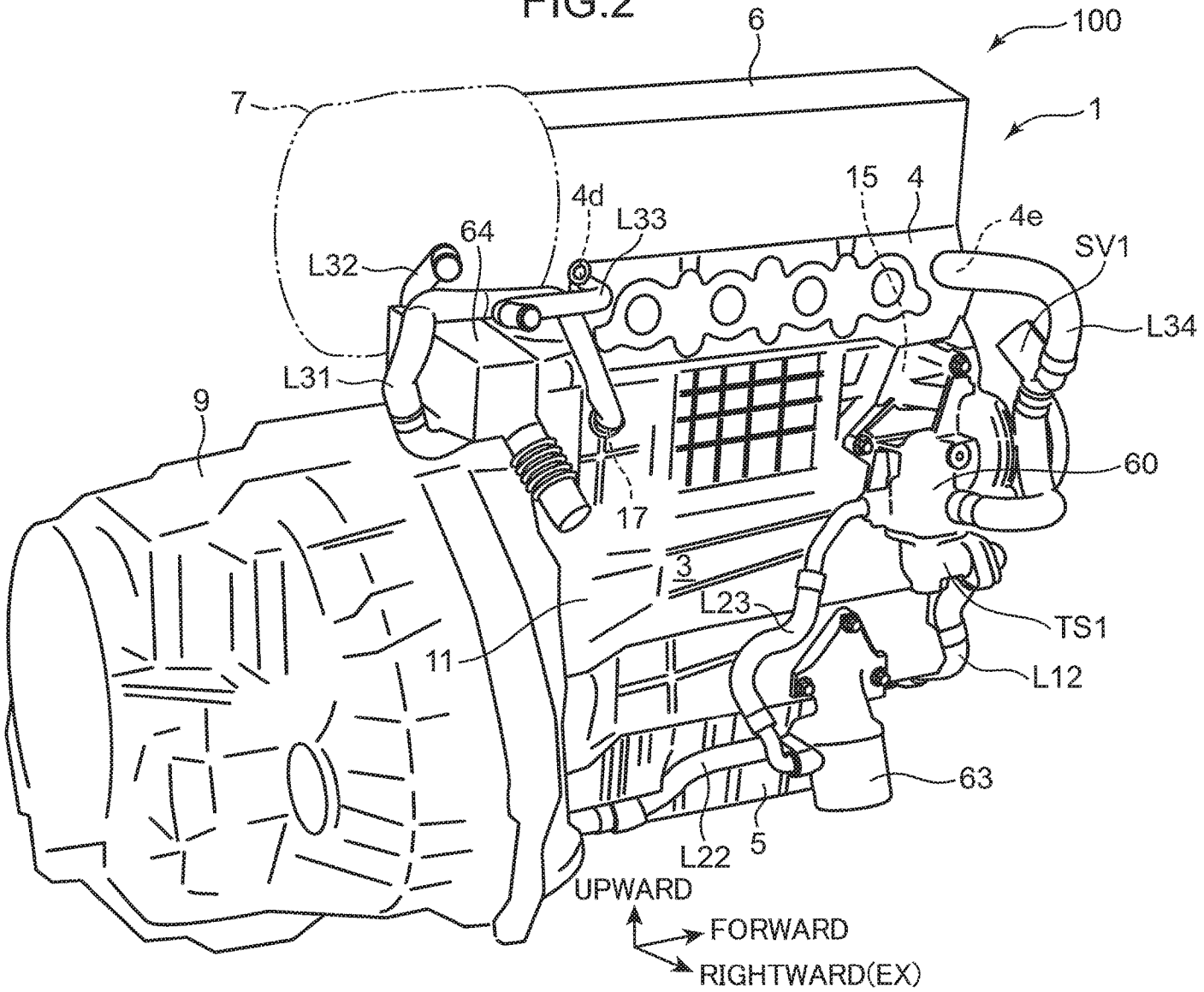
FIG. 2 is a perspective view of an engine body and peripheral devices thereof when viewed from an exhaust side.

The ATF warmer 62 is a device for warming automatic transmission fluid (ATF), which is a working oil for an automatic transmission 9 (see FIG. 2). That is, in the present embodiment, the automatic transmission 9 that transmits rotation of the engine body 1 to an axle while shifting the rotation is connected to the engine body 1. The ATF warmer 62 warms the ATF in the automatic transmission 9. In the ATF warmer 62, passages through which the ATF and the coolant circulate are formed. The ATF is heated by heat exchange between the ATF and the coolant circulating through the passages in the ATF warmer 62.

The oil cooler 63 is a device for cooling an engine oil, which is a lubricant for lubricating each part of the engine body 1. In the oil cooler 63, passages through which the engine oil and the coolant circulate are formed. The engine oil is cooled by heat exchange between the engine oil and the coolant circulating through the passages in the oil cooler 63.

The EGR cooler 64 is a device for cooling an EGR gas. That is, in the present embodiment, an EGR passage (not shown) that causes an exhaust passage (not shown) and an intake passage (not shown) connected to the engine body 1 to communicate with each other is provided in order to introduce a part of the exhaust gas discharged from the engine body 1 into the engine body 1. The EGR cooler 64 is provided in the EGR passage. The EGR cooler 64 cools the EGR gas, which is an exhaust gas recirculated to intake air (intake air to be introduced into the engine body 1) through the EGR passage. In the EGR cooler 64, passages through which the EGR gas and the coolant circulate are formed. The EGR gas is cooled by heat exchange between the EGR gas and the coolant circulating through the passages in the EGR cooler 64.

The heater 65 is a heater for heating (air conditioning) for introducing warm air into a vehicle interior or the like. In the heater 65, passages through which air and the coolant circulate are formed. The air is heated by heat exchange between the air and the coolant circulating through the passages in the heater 65.

In this way, the coolant cools the engine body 1 and performs heat exchange with an object fluid in each device. The engine system 100 is provided with a plurality of passages for circulating the coolant between the water pump 60, and the engine body 1 and each device. Specifically, the engine system 100 includes: a main passage L10 that circulates the coolant between the water pump 60 and the radiator 61; a first auxiliary passage L20 that circulates the coolant between the water pump 60, and the ATF warmer 62 and the oil cooler 63; and a second auxiliary passage L30 that circulates the coolant between the water pump 60, and the EGR cooler 64 and the heater 65.

The main passage L10 includes the coolant-introducing hole 15, the water jacket 20, a first head side jacket 4*a*, a radiator introduction passage L11, and a radiator outlet passage L12. The first head side jacket 4*a* is a passage (water jacket) formed in the cylinder head 4 and extending in a front-to-back direction. The radiator introduction passage L11 is a passage connecting the first head side jacket 4*a* and the radiator 61. The radiator outlet passage L12 is a passage connecting the radiator 61 and the water pump 60.

The first head side jacket 4*a* is formed to pass near the center of each cylinder 2. A rear end of the first head side jacket 4*a* and a rear end of the water jacket 20 communicate with each other in an up-and-down direction. The first head side jacket 4*a* opens on an intake side surface of a front end of the cylinder head 4, and the radiator introduction passage L11 is connected to an opening 4*c* (hereinafter referred to as a first head side outlet part 4*c*).

In the main passage L10, the coolant discharged from the water pump 60 flows into the water jacket 20 through the coolant-introducing hole 15, enters the first head side jacket 4*a* from a rear end of the water jacket 20, and then flows into the radiator introduction passage L11 through the first head side outlet part 4*c*. Thereafter, the coolant is cooled by the radiator 61 and returns to the water pump 60 again through the radiator outlet passage L12.

In the radiator outlet passage L12, a main switching device TS1 that opens and closes the radiator outlet passage L12 and thus the main passage L10 is provided. The main switching device TS1 includes a thermostat and a switching valve. When the temperature of the coolant circulating through the radiator outlet passage L12 is lower than a predetermined temperature, the switching valve of the main switching device TS1 is closed, and circulation of the coolant through the main passage L10 stops. On the other hand, when the temperature of the coolant circulating through the radiator outlet passage L12 is equal to or higher than the predetermined temperature, the switching valve of the main switching device TS1 is opened, and the coolant can circulate through the main passage L10. This predetermined temperature is set at about 95° C., for example. In the present embodiment, the predetermined temperature is changed based on a command from a power control module (PCM) provided in a vehicle. Note that the PCM is a device for controlling each part of the engine system 100, and as is well known, the PCM is a microprocessor including a central processing unit (CPU), a read-only memory (ROM), a random access memory (RAM), and the like.

The first auxiliary passage L20 includes the coolant-introducing hole 15, the water jacket 20, the first block side outlet hole 16, an ATF warmer introduction passage L21, an ATF warmer outlet passage L22, and an oil cooler outlet passage L23. The ATF warmer introduction passage L21 is a passage connecting the first block side outlet hole 16 and the ATF warmer 62. The ATF warmer outlet passage L22 is a passage connecting the ATF warmer 62 and the oil cooler 63. The oil cooler outlet passage L23 is a passage connecting the oil cooler 63 and the water pump 60.

In the first auxiliary passage L20, the coolant discharged from the water pump 60 flows into the water jacket 20 through the coolant-introducing hole 15, and is then led out from the first block side outlet hole 16 to the ATF warmer introduction passage L21. Then, the coolant flows into the ATF warmer 62 to heat the ATF, and then flows into the oil cooler 63 through the ATF warmer outlet passage L22. The coolant cooled down by heating the ATF cools the oil in the oil cooler 63, and then returns to the water pump 60 through the oil cooler outlet passage L23.

In the ATF warmer introduction passage L21, a first auxiliary switching device TS2 that opens and closes the ATF warmer introduction passage L21 and thus the first auxiliary passage L20 is provided. The first auxiliary switching device TS2 includes a thermostat and a switching valve. When the temperature of the coolant circulating through the ATF warmer introduction passage L21 is lower than a predetermined temperature, the switching valve of the first auxiliary switching device TS2 is closed, and circulation of the coolant through the first auxiliary passage L20 stops. On the other hand, when the temperature of the coolant circulating through the ATF warmer introduction passage L21 is equal to or higher than the predetermined temperature, the switching valve of the first auxiliary switching device TS2 is opened, and the coolant can circulate through the first auxiliary passage L20. This predetermined temperature is set at about 65° C., for example.

The second auxiliary passage L30 includes the coolant-introducing hole 15, the water jacket 20, the second block side outlet hole 17, an EGR cooler introduction passage L31, an EGR cooler outlet passage L32, a heater outlet passage L33, a second head side jacket 4*b*, and a head outlet passage L34. The EGR cooler introduction passage L31 is a passage connecting the second block side outlet hole 17 and the EGR cooler 64. The EGR cooler outlet passage L32 is a passage connecting the EGR cooler 64 and the heater 65. The heater outlet passage L33 is a passage connecting the heater 65 and the second head side jacket 4*b*. The second head side jacket 4*b* is a passage (water jacket) formed in the cylinder head 4 and extending in a front-to-back direction. The head outlet passage L34 is a passage connecting the second head side jacket 4*b* and the water pump 60.

The second head side jacket 4*b* is positioned on the exhaust side of the first head side jacket 4*a*, and passes around the exhaust port of each cylinder 2. The second head side jacket 4*b* is open at the rear end of the exhaust side surface of the cylinder head 4, and the heater outlet passage L33 is connected to an opening 4*d* (hereinafter referred to as a head side introduction part 4*d*). The second head side jacket 4*b* is open at the front end of the exhaust side surface of the cylinder head 4, and an opening 4*e* (hereinafter referred to as a second head side outlet part 4*e*) and the head outlet passage L34 are connected.

In the cylinder head 4, a communication passage 4*f* connecting the first head side jacket 4*a* and the second head side jacket 4*b* is provided. A part of the coolant in the first head side jacket 4*a* can flow into the second head side jacket 4*b* through the communication passage 4*f*.

In the second auxiliary passage L30, the coolant discharged from the water pump 60 flows into the water jacket 20 through the coolant-introducing hole 15, and is then led out from the second block side outlet hole 17 to the EGR cooler introduction passage L31. Then, the coolant flows into the EGR cooler 64 to cool the EGR gas, and then flows into the heater 65 through the EGR cooler outlet passage L32. The coolant warmed up by cooling the EGR gas heats the air in the heater 65, and then passes through the heater outlet passage L33 and enters the second head side jacket 4*b* via the head side introduction part 4*d*. The coolant cooled down by heating the air in the heater 65 moves forward in the second head side jacket 4*b* while cooling the cylinder head 4, and returns to the water pump 60 through the second head side outlet part 4*e* and the head outlet passage L34.

In the head outlet passage L34, a second auxiliary switching device SV1 that opens and closes the head outlet passage L34 and thus the second auxiliary passage L30 is provided. The second auxiliary switching device SV1 includes a solenoid valve that opens and closes the head outlet passage L34. An opening degree of the solenoid valve can be changed to a fully closed position, a fully opened position, or an intermediate opening degree between the fully closed position and the fully opened position, and is changed by the PCM according to an engine operating state or the like. When the solenoid valve is closed, circulation of the coolant in the second auxiliary passage L30 stops. When the solenoid valve is opened, the coolant can circulate through the second auxiliary passage L30.

Here, each of the passages L10, L20, and L30 includes the water jacket 20. However, as will be described later, the water jacket 20 is divided by a spacer 30 into a passage constituting a part of the main passage L10, a passage constituting a part of the first auxiliary passage L20, and a passage constituting a part of the second auxiliary passage L30.

(2) Structure Around the Engine

Figure 3:
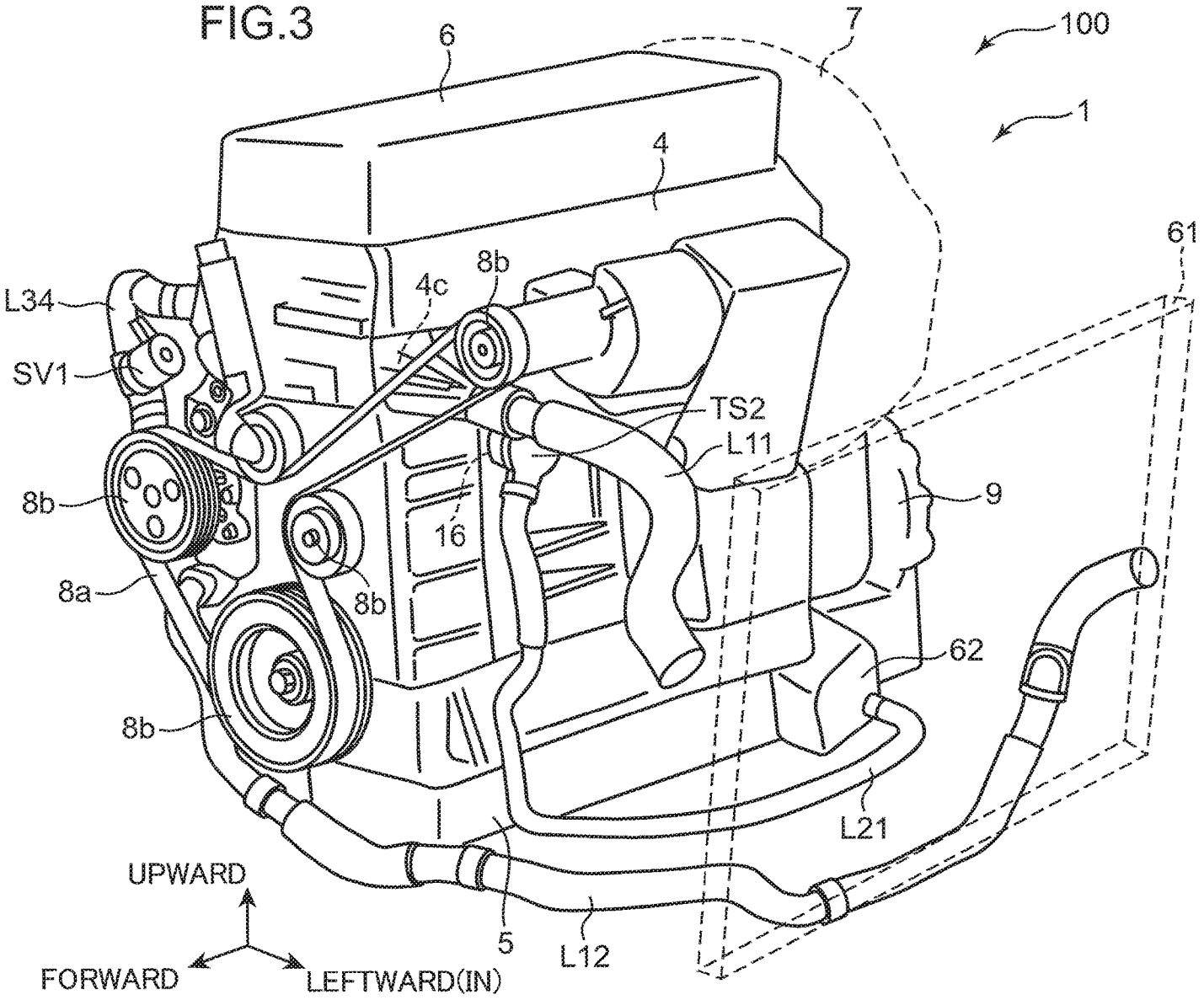
FIG. 3 is a perspective view of the engine body and peripheral devices thereof when viewed from an intake side.
Figure 4:
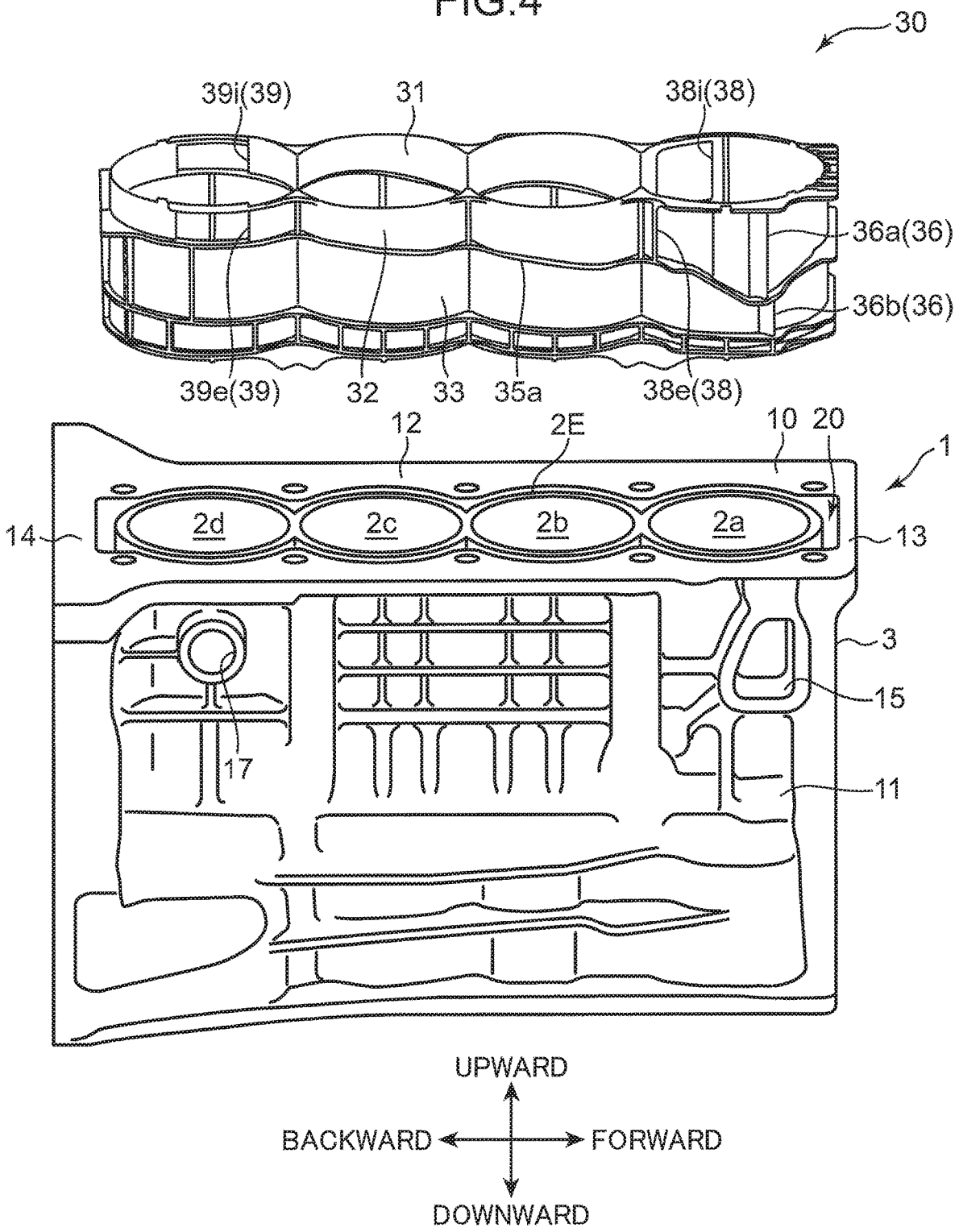
FIG. 4 is a perspective view showing a cylinder block and a spacer.
Figure 5:
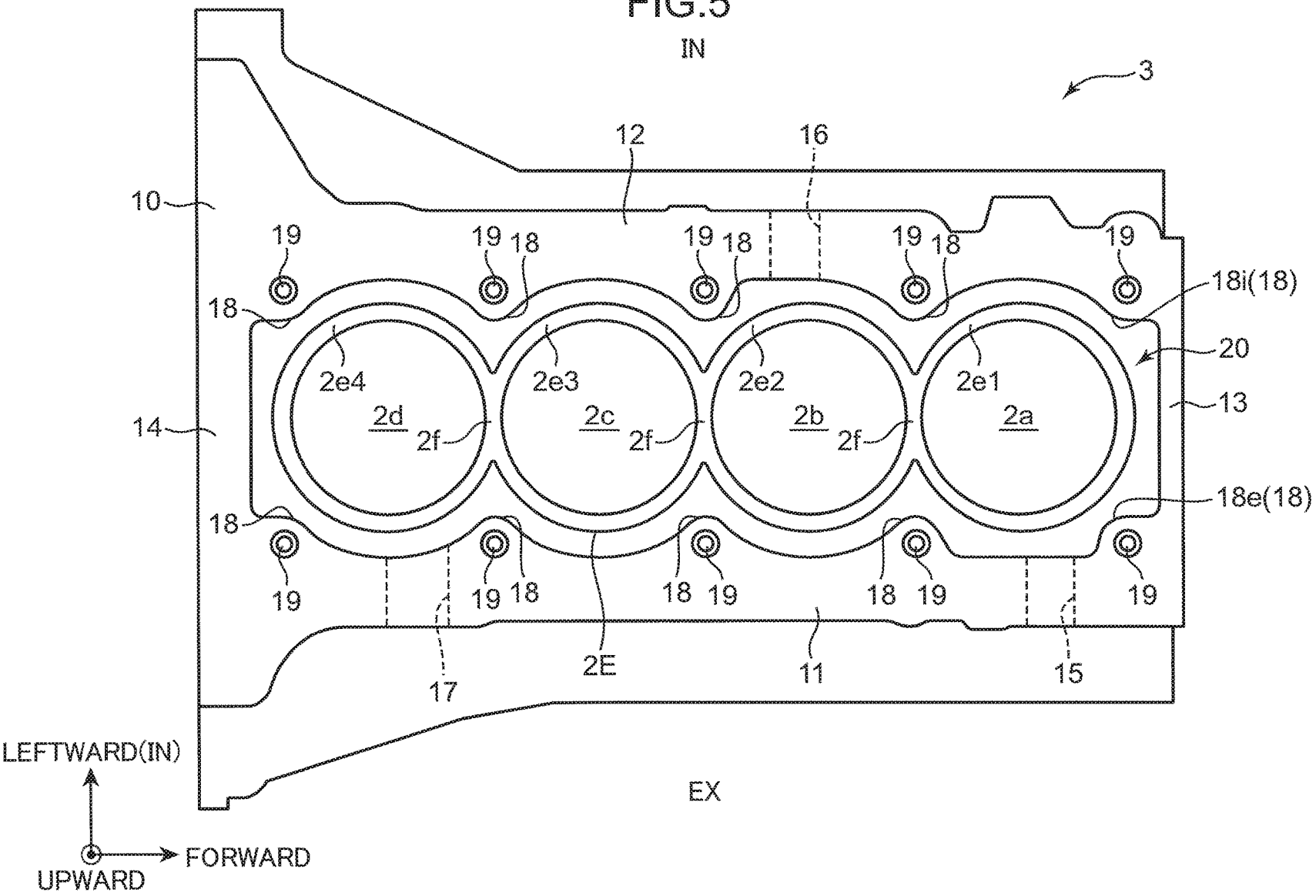
FIG. 5 is a top view of the cylinder block.

FIG. 2 is a perspective view of the engine body 1 and peripheral devices thereof when viewed from the exhaust side. FIG. 3 is a perspective view of the engine body 1 and peripheral devices thereof when viewed from the intake side. FIG. 4 is a perspective view showing the cylinder block 3 and the spacer 30. FIG. 5 is a top view of the cylinder block 3 with the spacer 30 not housed in the water jacket 20.

The engine body 1 includes, in addition to the cylinder block 3 and the cylinder head 4, a head cover 6 covering a camshaft or the like provided above the cylinder head 4, various auxiliary machines 7, and an oil pan 5 provided below the cylinder block 3. The automatic transmission 9 is disposed backward of the cylinder block 3. The radiator 61 is disposed on the intake side of the engine body 1.

As shown in FIG. 5 and other figures, the block outer peripheral wall 10 is formed in a substantially rectangular shape. The block outer peripheral wall 10 includes an exhaust side wall 11 extending in a front-to-back direction on the exhaust side, an intake side wall 12 extending substantially parallel to the exhaust side wall 11 on the intake side, a front side wall 13 extending in a right-to-left direction between the front end of the exhaust side wall 11 and the front end of the intake side wall 12, and a rear side wall 14 extending in a right-to-left direction between the rear end of the exhaust side wall 11 and the rear end of the intake side wall 12.

In the block outer peripheral wall 10, a plurality of bolt holes 19 opened on an upper surface thereof is formed. Head bolts for fastening the cylinder block 3 and the cylinder head 4 are screwed into the bolt holes 19. Each of the exhaust side wall 11 and the intake side wall 12 is provided with bulging parts 18 each bulging inward (toward the block inner peripheral wall 2E) at the front end, the rear end, and intermediate positions facing boundaries between the adjacent cylinders 2. One bolt hole 19 is formed in each of the bulging parts 18.

As shown in FIG. 3, the water pump 60 is coupled to a crankshaft via a belt 8*a* and a plurality of pulleys 8*b* and is driven by the crankshaft, that is, by the engine, to discharge the coolant. The water pump 60 is fixed to the front end of the exhaust side wall 11. The coolant-introducing hole 15 is formed at the front end of the exhaust side wall 11. As shown in FIG. 5 and other figures, the coolant-introducing hole 15 is positioned forward of the center of the first cylinder 2*a* in a front-to-back direction. In more detail, the coolant-introducing hole 15 faces a part of a front side and exhaust side of a wall part (first cylinder wall 2*e*1 described later) corresponding to the first cylinder 2*a* in the block inner peripheral wall 2E, the part being curved such that the part is positioned closer to the intake side as the part is closer to the front.

As shown in FIG. 3, the first head side outlet part 4*c* is open at the front end of the intake side surface of the cylinder head 4. The radiator introduction passage L11 extends leftward from the front end of the intake side surface of the cylinder head 4 toward the radiator 61. The radiator outlet passage L12 passes forward of the engine body 1 and extends from the radiator 61 to the water pump 60. As shown in FIG. 2, the main switching device TS1 is provided near the water pump 60.

As shown in FIGS. 3, 5 and other figures, the first block side outlet hole 16 is formed in the intake side wall 12. The first block side outlet hole 16 is formed at a position facing the second cylinder 2*b*. The ATF warmer 62 is disposed close to the rear end of the intake side part of the oil pan 5. The ATF warmer introduction passage L21 extends from the first block side outlet hole 16 to the ATF warmer 62 along the intake side surface of the engine body 1. As shown in FIG. 2, the oil cooler 63 is fixed to a lower part of the exhaust side surface of the cylinder block 3. The ATF warmer outlet passage L22 passes below the oil pan 5 and extends from the ATF warmer 62 to the oil cooler 63. The oil cooler outlet passage L23 extends obliquely upward and forward from the oil cooler 63, and is connected to the water pump 60 at the upper end thereof.

As shown in FIGS. 2, 5 and other figures, the second block side outlet hole 17 is formed in the exhaust side wall 11. The second block side outlet hole 17 is formed at a position facing the fourth cylinder 2*d*. The EGR cooler 64 is disposed backward of the cylinder block 3 to extend to the right and left. The EGR cooler introduction passage L31 extends from the second block side outlet hole 17 so as to go around an upper part of the EGR cooler 64 and is connected to a lower surface of the EGR cooler 64. The EGR cooler outlet passage L32 extends upward from the EGR cooler 64. Although the heater 65 is not shown in FIG. 2, the EGR cooler outlet passage L32 extends to the heater 65. The head side introduction part 4*d* is open at the rear end of the exhaust side surface of the cylinder head 4. The heater outlet passage L33 extends from the heater 65 to the rear end of the exhaust side surface of the cylinder head 4. The second head side outlet part 4*e* is open at the front end of the exhaust side surface of the cylinder head 4. The head outlet passage L34 extends rightward from the front end of the exhaust side surface of the cylinder head 4 and then extends downward, and is connected to the water pump 60 at its lower end. The second auxiliary switching device SV1 is provided in an intermediate part of an up-and-down direction of the head outlet passage L34.

(3) Detailed Structure of the Spacer and the Water Jacket

The detailed structure of the spacer 30 and the water jacket 20 will be described.

Figure 6:
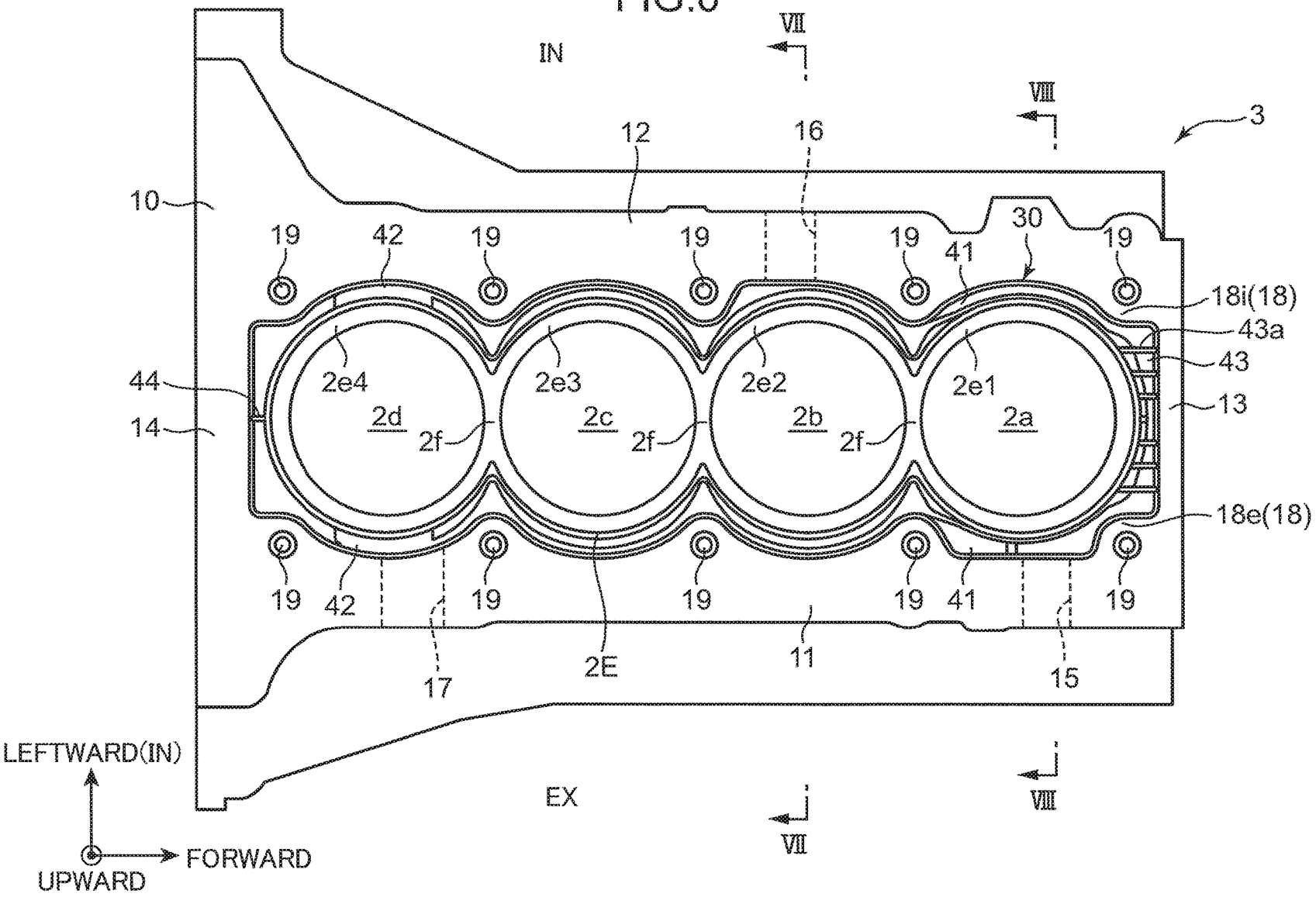
FIG. 6 is a top view of the cylinder block in which the spacer is housed.
Figure 7:
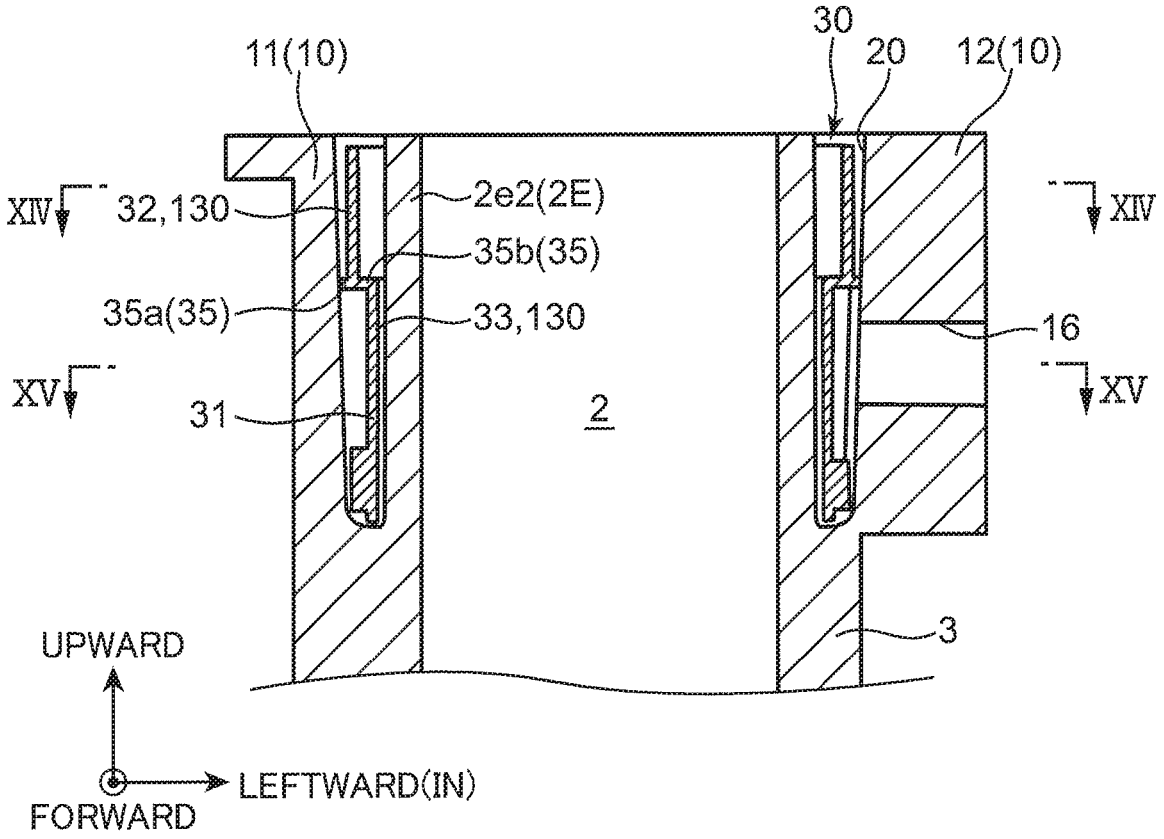
FIG. 7 is a cross-sectional view along the line VII-VII of FIG. 6.
Figure 8:
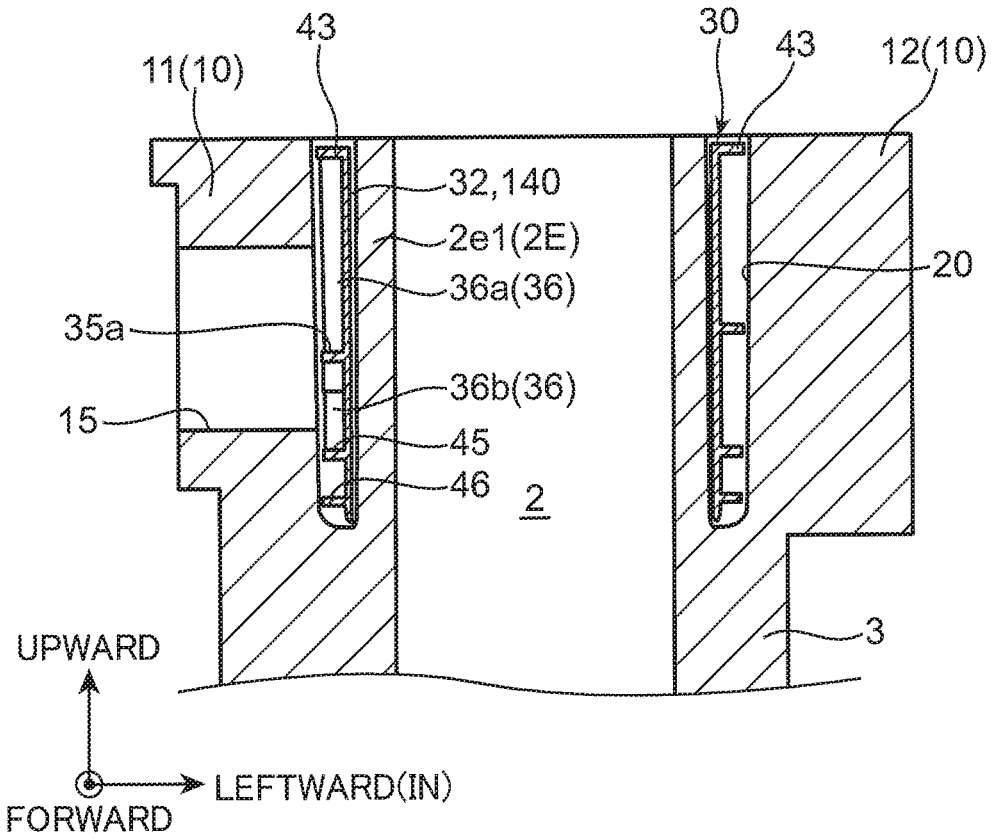
FIG. 8 is a cross-sectional view along the line VIII-VIII of FIG. 6.
Figure 9:
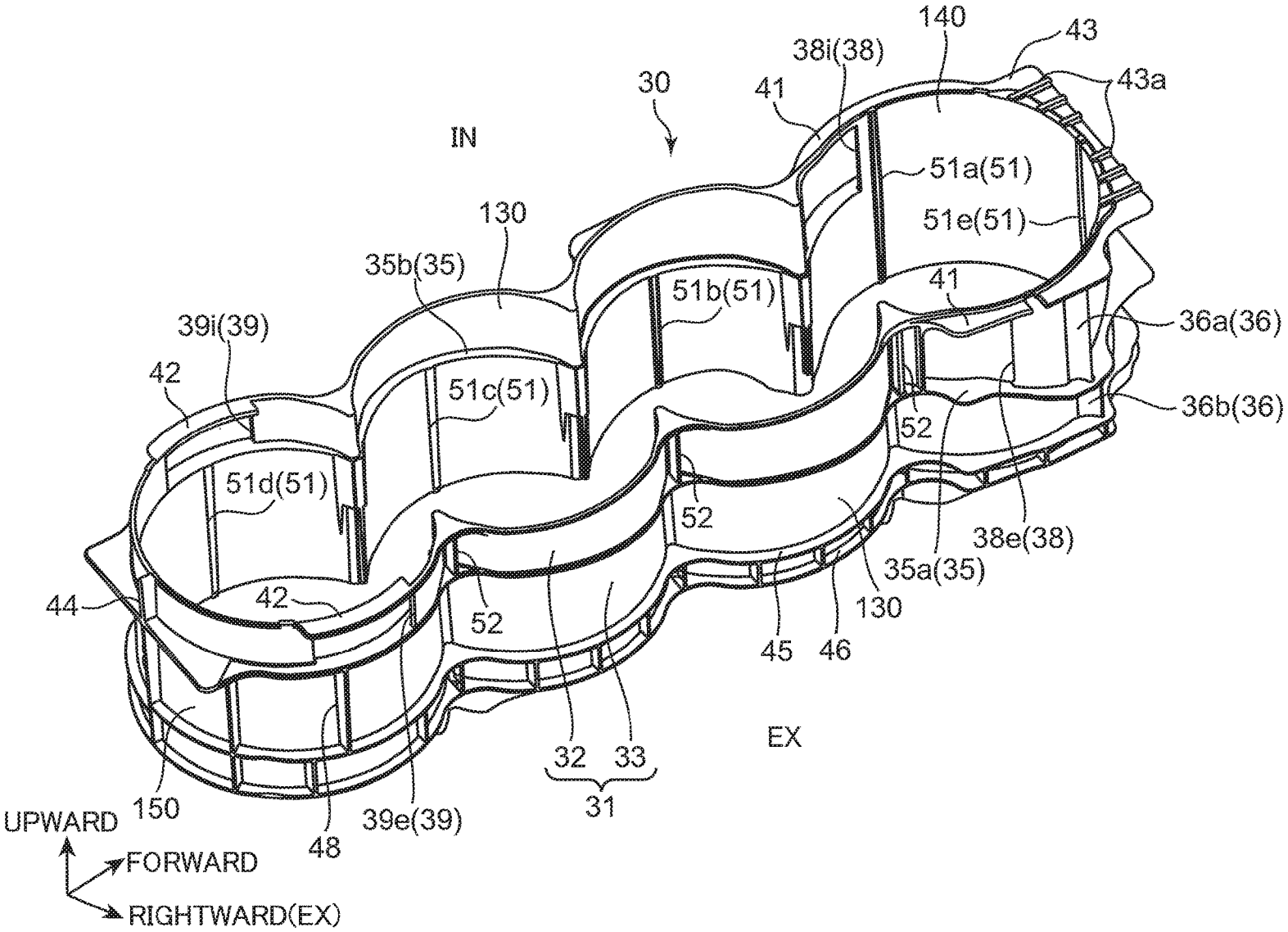
FIG. 9 is a perspective view of the spacer.
Figure 10:
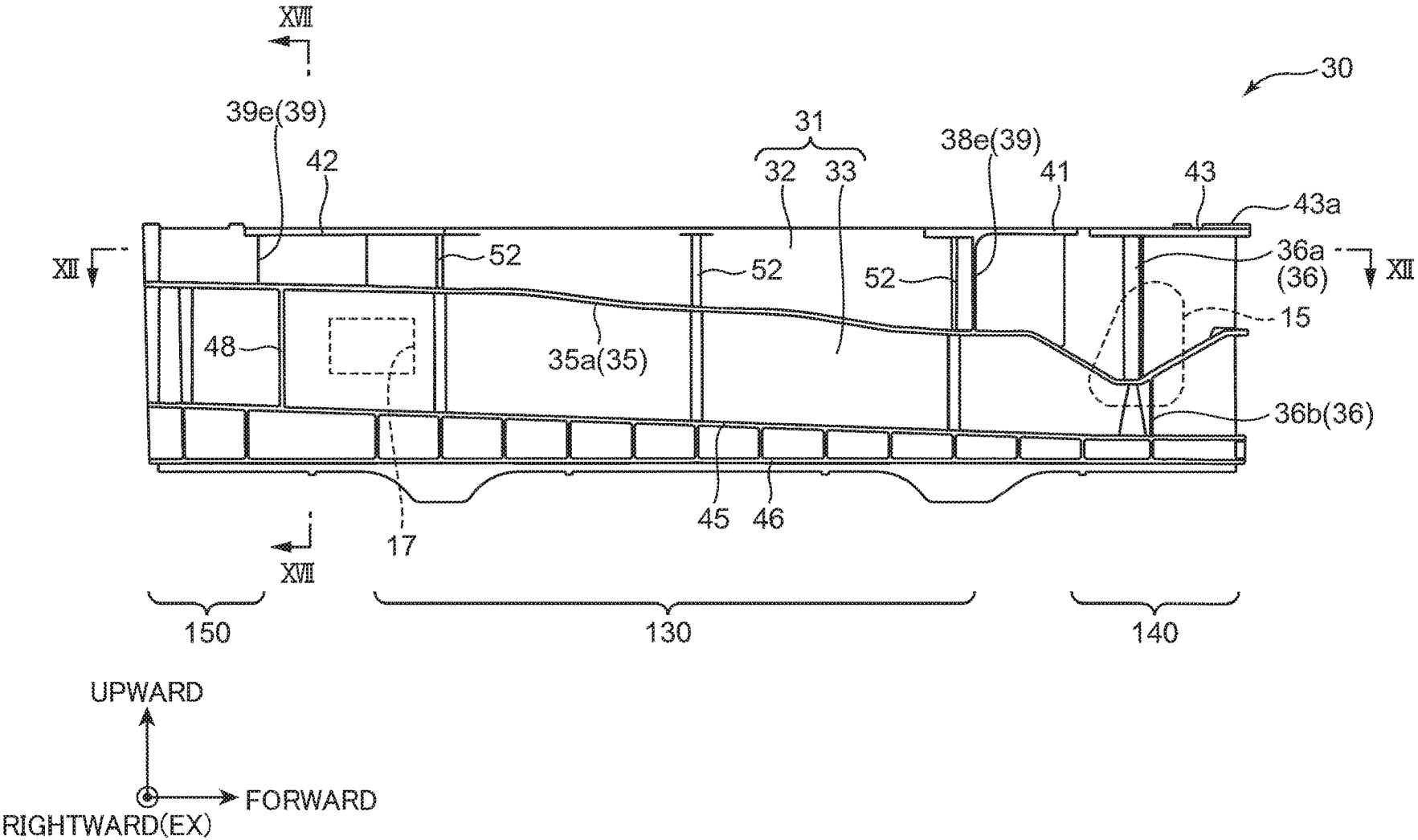
FIG. 10 is a side view of an exhaust side of the spacer.
Figure 11:
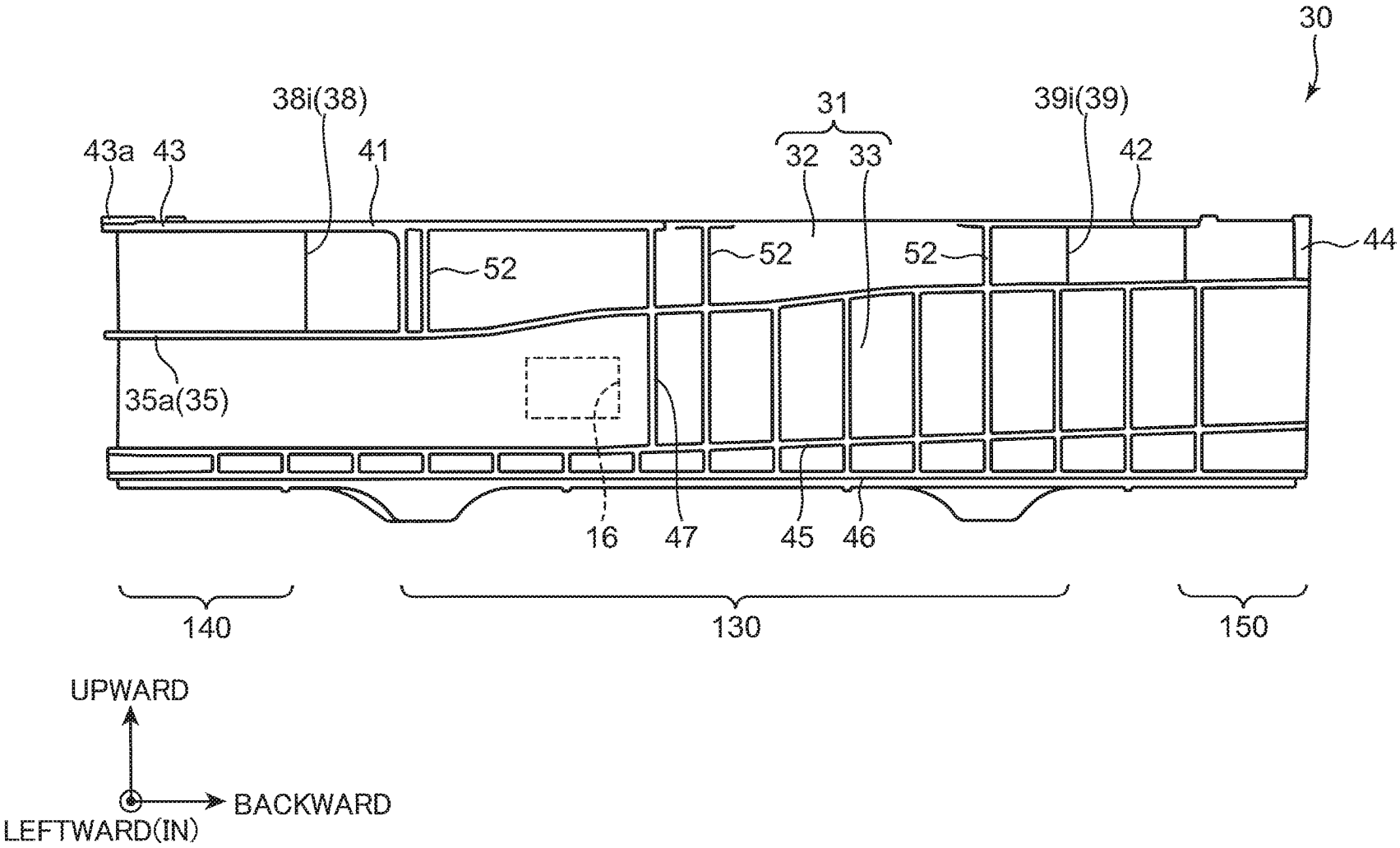
FIG. 11 is a side view of an intake side of the spacer.
Figure 12:
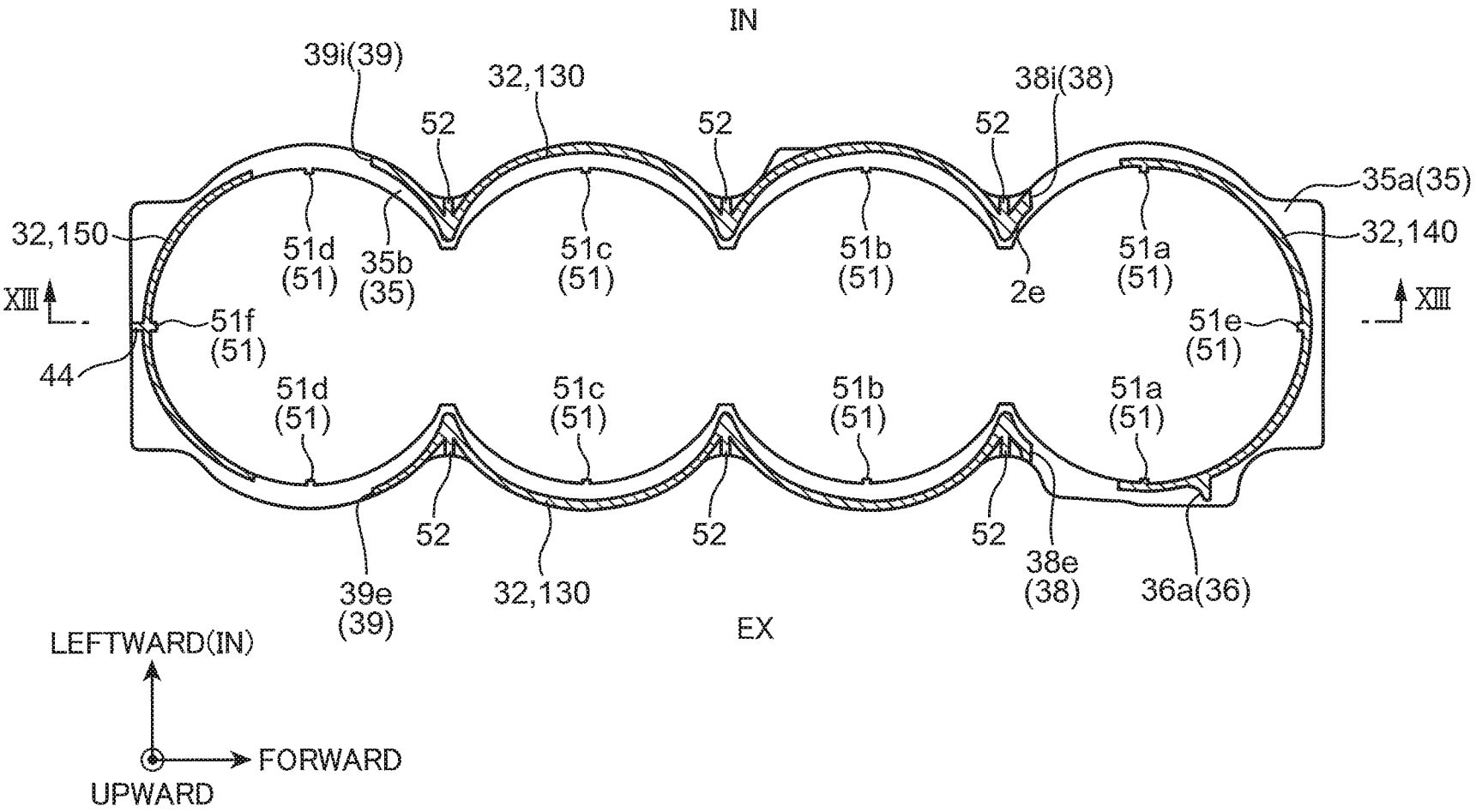
FIG. 12 is a cross-sectional view of the spacer along the line XII-XII of FIG. 10.
Figure 13:
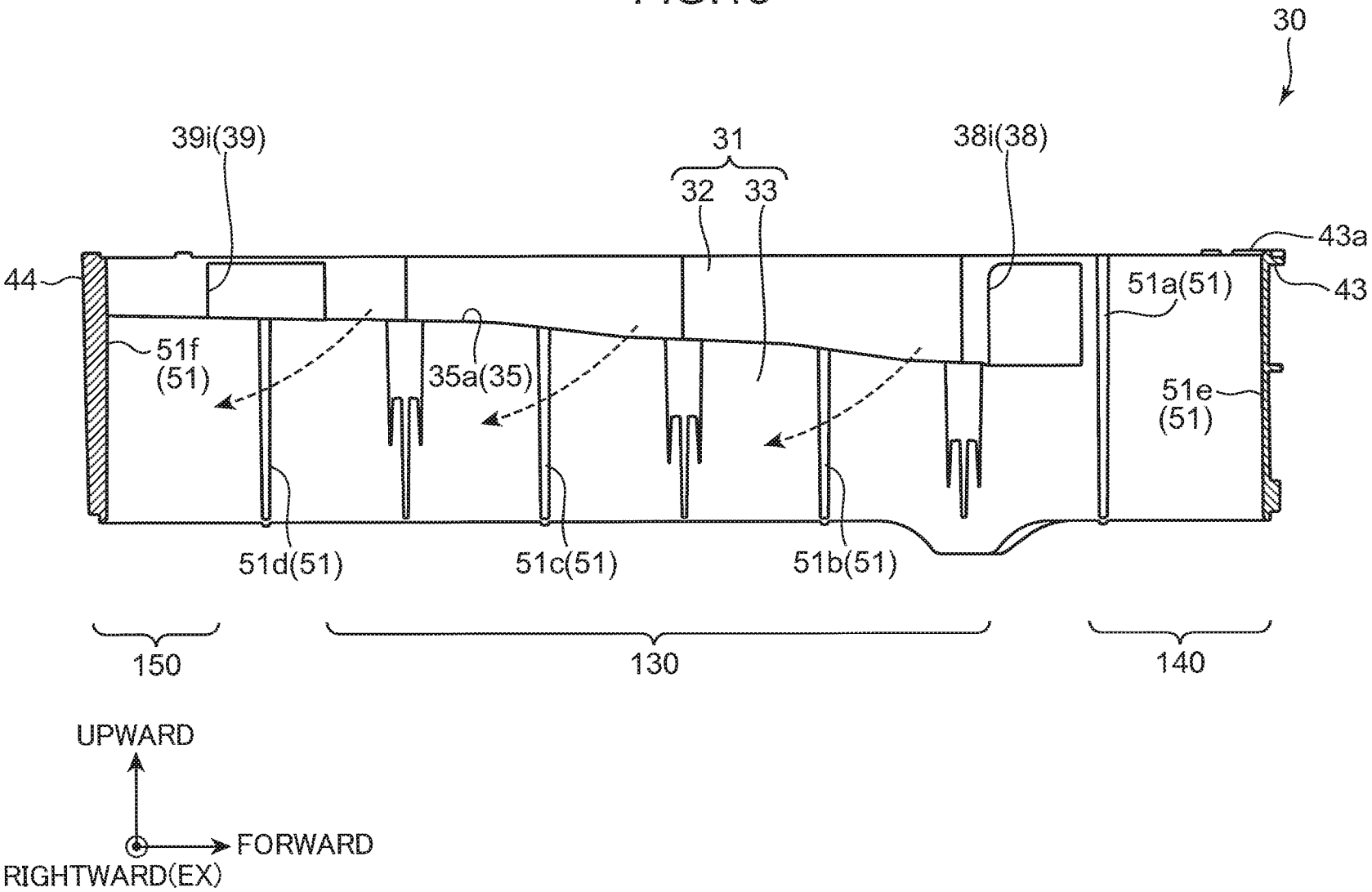
FIG. 13 is a cross-sectional view of the spacer along the line XIII-XIII of FIG. 12.
Figure 14:
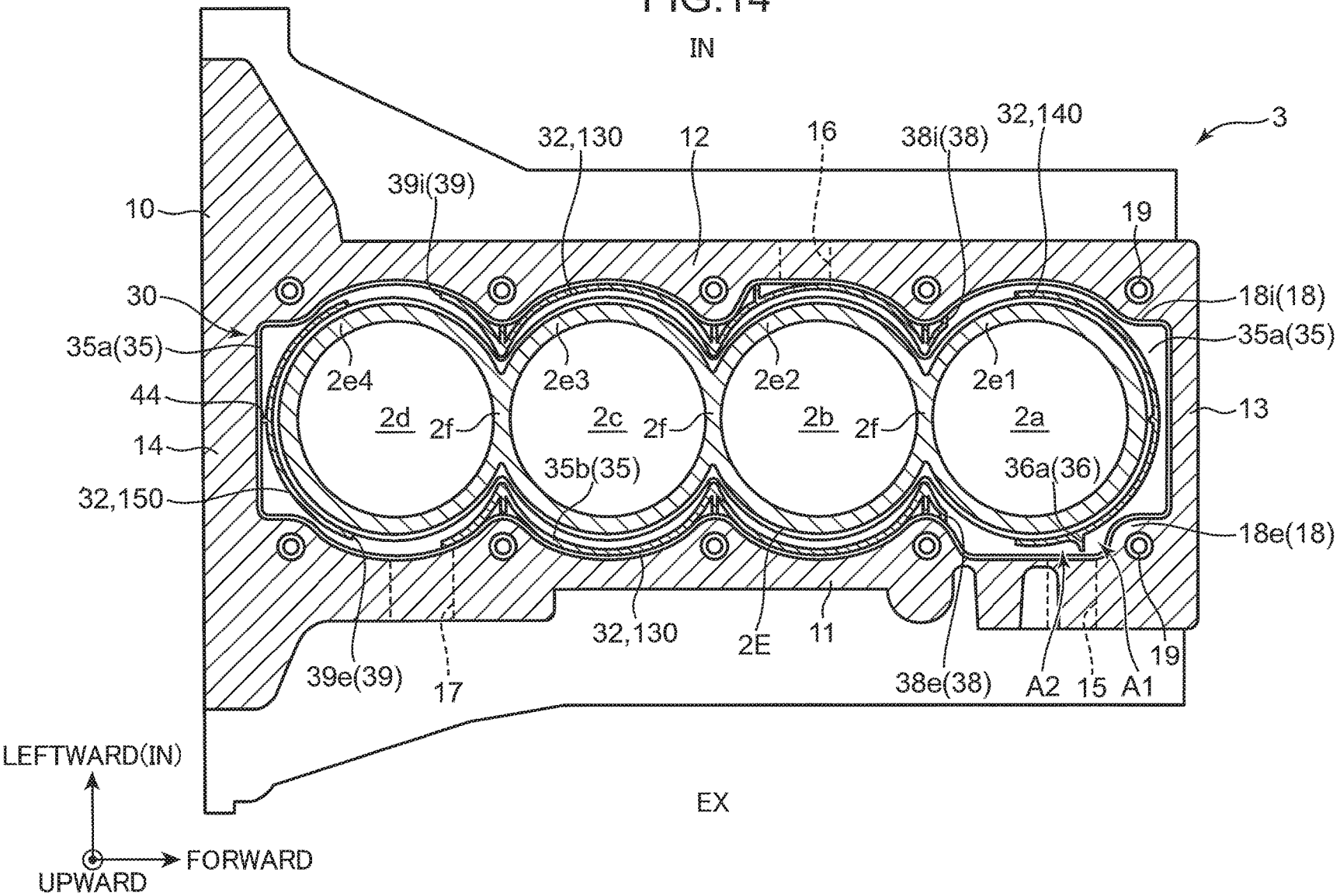
FIG. 14 is a cross-sectional view of the spacer along the line XIV-XIV of FIG. 7.
Figure 15:
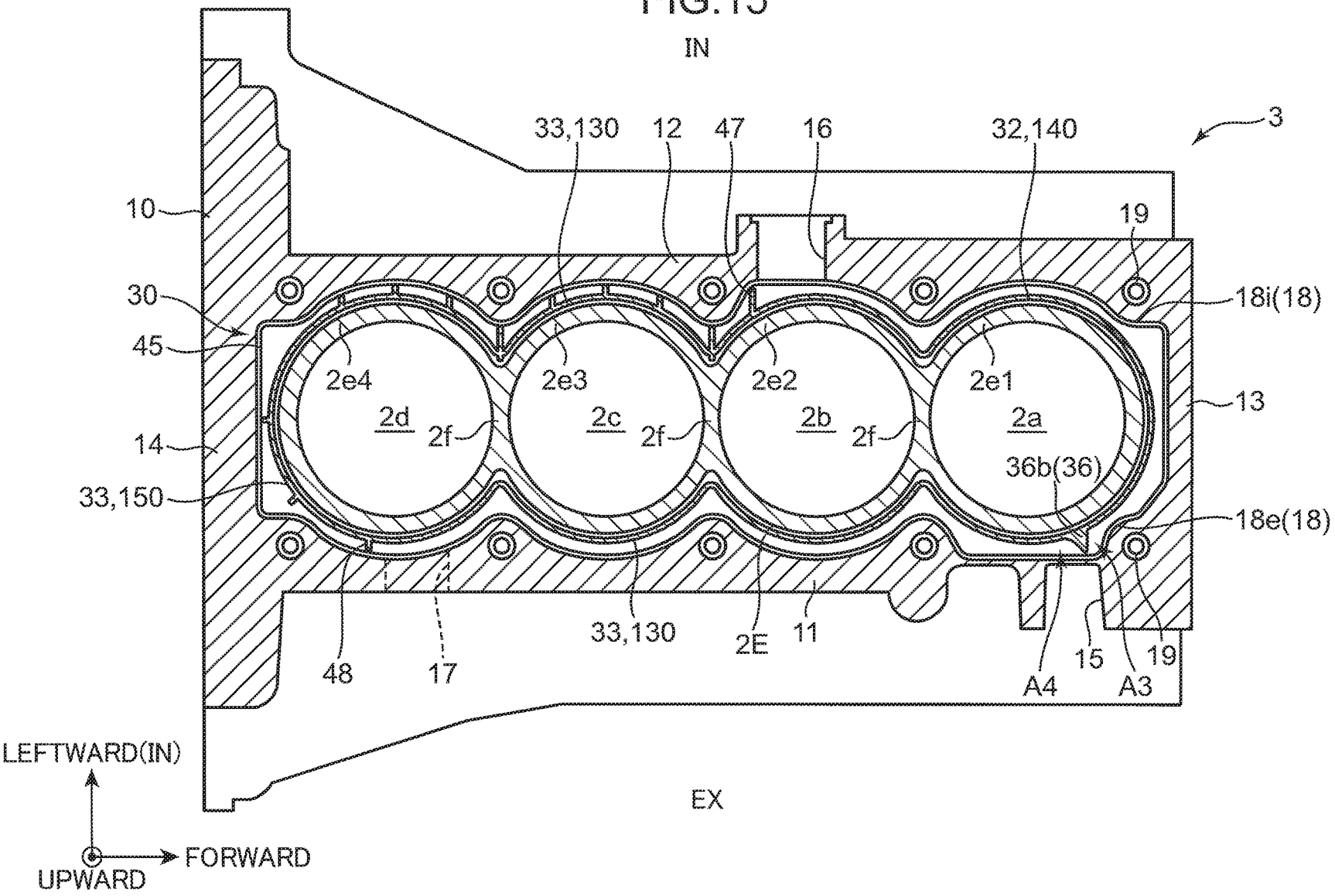
FIG. 15 is a cross-sectional view of the spacer along the line XV-XV of FIG. 7.

FIG. 6 is a drawing corresponding to FIG. 5 and is a top view of the cylinder block 3 with the spacer 30 housed in the water jacket 20. FIG. 7 is a cross-sectional view along the line VII-VII of FIG. 6. FIG. 8 is a cross-sectional view along the line VIII-VIII of FIG. 6. FIG. 9 is a perspective view of the spacer 30. FIG. 10 is a side view of the exhaust side of the spacer 30, and FIG. 11 is a side view of the intake side of the spacer 30. FIG. 12 is a cross-sectional view of the spacer 30 along the line XII-XII of FIG. 10. FIG. 13 is a cross-sectional view of the spacer 30 along the line XIII-XIII of FIG. 12. FIG. 14 is a cross-sectional view along the line XIV-XIV of FIG. 7. FIG. 15 is a cross-sectional view along the line XV-XV of FIG. 7.

The spacer 30 is housed in the water jacket 20 in contact with a bottom surface of the water jacket 20. The spacer 30 is made of, for example, a material (for example, a synthetic resin) having a lower thermal conductivity than a material of the cylinder block 3 (for example, an aluminum alloy).

The spacer 30 includes a peripheral wall 31 surrounding the entire outer periphery of the block inner peripheral wall 2E defining each cylinder 2. The peripheral wall 31 divides the water jacket 20 into an inner space close to the cylinders 2 and an outer space far from the cylinders 2. The block inner peripheral wall 2E and the peripheral wall 31 extend in a substantially arc shape in top view along each cylinder 2.

The block inner peripheral wall 2E integrally includes a first cylinder wall 2*e*1 defining the first cylinder 2*a*, a second cylinder wall 2*e*2 defining the second cylinder 2*b*, a third cylinder wall 2*e*3 defining the third cylinder 2*c*, and a fourth cylinder wall 2*e*4 defining the fourth cylinder 2*d*. The first cylinder wall 2*e*1 to the fourth cylinder wall 2*e*4 are each formed in a cylindrical shape and connected to each other. An inter-bore part 2*f* is formed between the cylinders 2 adjacent to each other, that is, between the first cylinder wall 2*e*1 and the second cylinder wall 2*e*2, between the second cylinder wall 2*e*2 and the third cylinder wall 2*e*3, and between the third cylinder wall 2*e*3 and the fourth cylinder wall 2*e*4. In other words, the inter-bore part 2*f* is a part shared between adjacent cylinder walls.

The peripheral wall 31 of the spacer 30 has a shape in which four circles are slightly overlapped and connected in top view and the overlap part is removed, corresponding to the shape of the block inner peripheral wall 2E described above. The peripheral wall 31 has a height similar to the depth of the water jacket 20. Accordingly, almost the entire water jacket 20 is divided into the inner space and the outer space by the peripheral wall 31.

The peripheral wall 31 includes first guide element 38 at a position facing the first cylinder wall 2*e*1. The first guide element 38 includes a pair of through holes penetrating the peripheral wall 31, that is, an intake side first through hole 38*i* and an exhaust side first through hole 38*e*. Both the first through holes 38*i* and 38*e* face each other in a right-to-left direction. In more detail, the intake side first through hole 38*i* faces an intake side surface at the rear of the first cylinder wall 2*e*1, and the exhaust side first through hole 38*e* faces an exhaust side surface at the rear of the first cylinder wall 2*e*1. Both the first through holes 38*i* and 38*e* are formed to face a range from a position slightly backward of the center in a front-to-back direction of the first cylinder wall 2*e*1 to a position slightly forward of the rear end of the first cylinder wall 2*e*1 (boundary between the first cylinder wall 2*e*1 and the second cylinder wall 2*e*2).

The peripheral wall 31 includes second guide element 39 at a position facing the fourth cylinder wall 2*e*4. The second guide element 39 includes a pair of through holes penetrating the peripheral wall 31, that is, an intake side second through hole 39*i* and an exhaust side second through hole 39*e*. Both the second through holes 39*i* and 39*e* face each other in a right-to-left direction. In more detail, the intake side second through hole 39*i* faces the intake side surface at the central part in a front-to-back direction of the fourth cylinder wall 2*e*4, and the exhaust side second through hole 39*e* faces the exhaust side surface at the central part in a front-to-back direction of the fourth cylinder wall 2*e*4. Both the second through holes 39*i* and 39*e* are formed to face a range including the center in a front-to-back direction of the fourth cylinder wall 2*e*4 and excluding the front end and the rear end of the fourth cylinder wall 2*e*4.

The outer space of the peripheral wall 31 and the inner space of the peripheral wall 31 communicate with each other via the first guide element 38 (intake side and exhaust side first through holes 38*i* and 38*e*) and the second guide element 39 (intake side and exhaust side second through holes 39*i* and 39*e*) described above. In the present embodiment, the first guide element 38 and the second guide element 39 correspond to the "guide element" of the claims, the intake side and exhaust side first through holes 38*i* and 38*e* correspond to the "first through hole" of the claims, and the intake side and exhaust side second through holes 39*i* and 39*e* correspond to the "second through hole" of the claims.

(Dividing Wall)

The spacer 30 includes a dividing wall 35 dividing the peripheral wall 31 vertically. The dividing wall 35 is provided over the entire circumference of the peripheral wall 31 and divides the peripheral wall 31 into an upper peripheral wall 32 and a lower peripheral wall 33. In other words, the spacer 30 includes the upper peripheral wall 32, the lower peripheral wall 33 below the upper peripheral wall 32, and the dividing wall 35 formed at a boundary between the upper peripheral wall 32 and the lower peripheral wall 33.

The dividing wall 35 includes an intermediate flange 35*a* and a step 35*b*.

Specifically, the peripheral wall 31 is provided with the intermediate flange 35*a* protruding outward (toward the block outer peripheral wall 10) from an intermediate position in an up-and-down direction of the outer peripheral surface thereof. The intermediate flange 35*a* is formed over the entire circumference of the peripheral wall 31. As shown in FIGS. 7 and 8, the intermediate flange 35*a* protrudes to a vicinity of the block outer peripheral wall 10. With this configuration, the space between the peripheral wall 31 and the block outer peripheral wall 10, that is, the space outside the peripheral wall 31 in the water jacket 20 is divided into spaces above and below the intermediate flange 35*a* over the entire circumference of the peripheral wall 31.

Furthermore, a part of the peripheral wall 31 from the rear end of the first guide element 38 to the front end of the second guide element 39 is formed such that the lower peripheral wall 33 is positioned inside the upper peripheral wall 32 (near the block inner peripheral wall 2E) on both the intake side and the exhaust side. The step 35*b* is formed to extend inward from the lower end of the upper peripheral wall 32 toward the upper end of the lower peripheral wall 33 so as to connect the upper peripheral wall 32 and the lower peripheral wall 33.

The intermediate flange 35*a* and the step 35*b* are provided at the same height position. In the part of the peripheral wall 31 from the rear end of the first guide element 38 to the front end of the second guide element 39, the peripheral wall 31 is divided into the upper peripheral wall 32 and the lower peripheral wall 33 by the intermediate flange 35*a* and the step 35*b*. Hereinafter, as appropriate, the part of the peripheral wall 31 from the rear end of the intake side first through hole 38*i* to the front end of the intake side second through hole 39*i*, and the part from the rear end of the exhaust side first through hole 38*e* to the front end of the exhaust side second through hole 39*e* are collectively referred to as a central peripheral wall 130.

As shown in FIG. 7 and other figures, the step 35*b* protrudes to a vicinity of the block inner peripheral wall 2E. With this configuration, the space between the central peripheral wall 130 and the block inner peripheral wall 2E, that is, the space inside the central peripheral wall 130 in the water jacket 20 is divided into spaces above and below the step 35*b* substantially over the entire circumference of the central peripheral wall 130.

The intermediate flange 35*a* and the step 35*b* are connected to each other in each of the guide elements 38 and 39, and constitute lower surfaces of the through holes (38*i*, 38*e*, 39*i*, 39*e*) constituting the guide elements 38 and 39. That is, each of the guide elements 38 and 39 is formed in the upper peripheral wall 32 constituting a part of the peripheral wall 31 above the intermediate flange 35*a* and the step 35*b*, and is formed as a through hole with the intermediate flange 35*a* and the step 35*b* as lower surfaces.

The step 35*b* is not formed in a part of the peripheral wall 31 forward of the front end of the first guide element 38, that is, a part including the front end of the peripheral wall 31 and ranging from the front end of the intake side first through hole 38*i* to the front end of the exhaust side first through hole 38*e* (hereinafter, as appropriate, this part is referred to as a front peripheral wall 140). In other words, the front peripheral wall 140 is divided into the upper peripheral wall 32 and the lower peripheral wall 33 only by the intermediate flange 35*a*. That is, an inner peripheral surface of the front peripheral wall 140 is not divided vertically, and only an outer peripheral surface is vertically divided by the intermediate flange 35*a*. With this configuration, as shown in FIG. 8, at the front part of the water jacket 20 into which the front peripheral wall 140 is inserted, only the space outside the peripheral wall 31 (space between the peripheral wall 31 and the block outer peripheral wall 10) is vertically divided by the intermediate flange 35*a*, and the space inside the peripheral wall 31 (space between the block inner peripheral wall 2E and the peripheral wall 31) is not divided vertically.

Similarly, the step 35*b* is not formed in a part of the peripheral wall 31 on a back side of the rear end of the second guide element 39, that is, a part including the rear end of the peripheral wall 31 and ranging from the rear end of the intake side second through hole 39*i* to the rear end of the exhaust side second through hole 39*e* (hereinafter, as appropriate, this part is referred to as a rear peripheral wall 150). In other words, the rear peripheral wall 150 is divided into the upper peripheral wall 32 and the lower peripheral wall 33 only by the intermediate flange 35*a*. That is, an inner peripheral surface of the rear peripheral wall 150 is not divided vertically, and only an outer peripheral surface is vertically divided by the intermediate flange 35*a*. With this configuration, at the rear part of the water jacket 20 into which the rear peripheral wall 150 is inserted, only the space outside the peripheral wall 31 (space between the peripheral wall 31 and the block outer peripheral wall 10) is vertically divided by the intermediate flange 35*a*, and the space inside the peripheral wall 31 (space between the block inner peripheral wall 2E and the peripheral wall 31) is not divided vertically.

Here, as shown in FIG. 15, the lower peripheral wall 33 is close to the block inner peripheral wall 2E over the entire circumference. Specifically, a clearance dimension between the lower peripheral wall 33 and the block outer peripheral wall 10 is larger than a clearance dimension between the lower peripheral wall 33 and the block inner peripheral wall 2E over the entire circumference of the peripheral wall 31. That is, in the lower region of the water jacket 20, a flow channel area is larger on the outside than on the inside of the peripheral wall 31 (lower peripheral wall 33).

Meanwhile, as shown in FIG. 14, the upper peripheral wall 32 of the central peripheral wall 130 is close to the block outer peripheral wall 10, and the upper peripheral wall 32 of each of the front peripheral wall 140 and the rear peripheral wall 150 is close to the block inner peripheral wall 2E. That is, a clearance dimension between the upper peripheral wall 32 of the front peripheral wall 140 and the block outer peripheral wall 10 is larger than a clearance dimension between the upper peripheral wall 32 of the front peripheral wall 140 and the block inner peripheral wall 2E. A clearance dimension between the upper peripheral wall 32 of the rear peripheral wall 150 and the block outer peripheral wall 10 is larger than a clearance dimension between the upper peripheral wall 32 of the rear peripheral wall 150 and the block inner peripheral wall 2E. Meanwhile, a clearance dimension between the upper peripheral wall 32 of the central peripheral wall 130 and the block outer peripheral wall 10 is smaller than a clearance dimension between the upper peripheral wall 32 of the central peripheral wall 130 and the block inner peripheral wall 2E. In other words, in the front part and rear part of the upper region of the water jacket 20 (regions corresponding to the front peripheral wall 140 and the rear peripheral wall 150), the flow channel area is larger on the outside than on the inside of the peripheral wall 31 (upper peripheral wall 32). In the central part of the upper region of the water jacket 20 (region corresponding to the central peripheral wall 130), the flow channel area is larger on the inside than on the outside of the peripheral wall 31.

Here, the central peripheral wall 130 extends from the rear part of the first cylinder 2*a* to the front part of the fourth cylinder 2*d*, and each inter-bore part 2*f* of the block inner peripheral wall 2E faces the central peripheral wall 130. With this configuration, in a part of the upper region of the water jacket 20 adjacent to each inter-bore part 2*f*, the flow channel area is larger on the inside than on the outside of the peripheral wall 31 (upper peripheral wall 32).

(Distribution Wall)

On the outer peripheral surface of the exhaust side of the peripheral wall 31, a distribution wall 36 extending in an up-and-down direction and protruding outward (toward the block outer peripheral wall 10) is provided. As shown in FIG. 9 and other figures, the distribution wall 36 is positioned on the front side of the exhaust side first through hole 38*e*. In the present embodiment, the distribution wall 36 is positioned on the front side of the center of the first cylinder 2*a* in a front-to-back direction. The intermediate flange 35*a* extends in the circumferential direction of the peripheral wall 31 so as to divide the distribution wall 36 vertically. The distribution wall 36 includes an upper distribution wall 36*a* extending upward from the intermediate flange 35*a* and a lower distribution wall 36*b* extending downward from the intermediate flange 35*a*.

Figure 16:
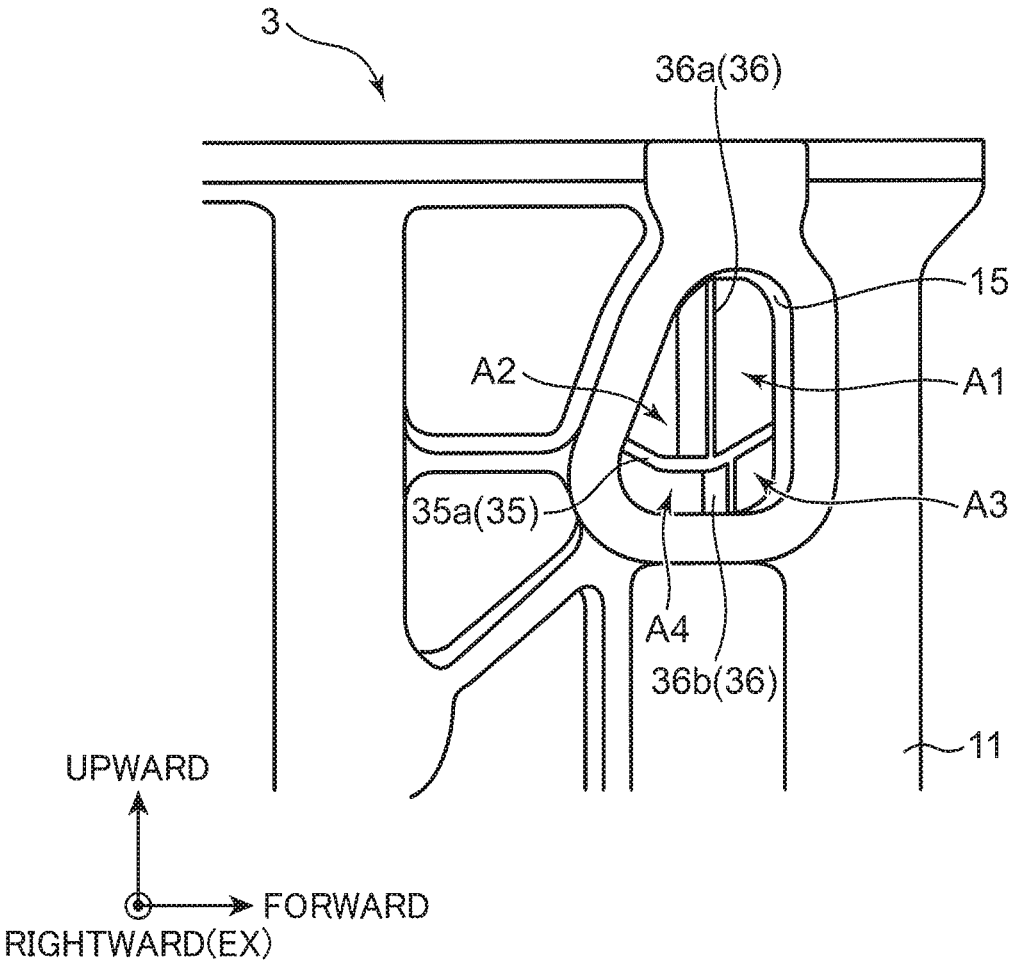
FIG. 16 is a side view in which a vicinity of a coolant-introducing part of the cylinder block is enlarged.

FIG. 16 is an enlarged view of the front end of the exhaust side of the cylinder block 3. As shown in FIG. 16, the distribution wall 36 and the coolant-introducing hole 15 face each other. When viewed from the outside of the coolant-introducing hole 15, the distribution wall 36 extends in an up-and-down direction at an intermediate position in a front-to-back direction of the coolant-introducing hole 15. A part of the intermediate flange 35*a* facing the coolant-introducing hole 15 is positioned between a lower end and an upper end of the coolant-introducing hole 15.

Accordingly, the region facing the coolant-introducing hole 15 in the peripheral wall 31, in other words, a region visually recognized from the outside through the coolant-introducing hole 15 in the space between the peripheral wall 31 and the block outer peripheral wall 10 is divided into four inflow parts shown in FIG. 16, that is, a first inflow part A1, a second inflow part A2, a third inflow part A3, and a fourth inflow part A4. The first inflow part A1 is a region positioned above the intermediate flange 35*a* and forward of the upper distribution wall 36*a*. The second inflow part A2 is a region positioned above the intermediate flange 35*a* and backward of the upper distribution wall 36*a*. The third inflow part A3 is a region positioned below the intermediate flange 35*a* and forward of the lower distribution wall 36*b*. The fourth inflow part A4 is a region positioned below the intermediate flange 35*a* and backward of the lower distribution wall 36*b*.

Areas of the inflow parts A1 to A4 when the peripheral wall 31 is viewed through the coolant-introducing hole 15 are areas of four regions defined by an inner opening edge of the coolant-introducing hole 15 and tips of the intermediate flange 35*a* and the distribution wall 36 (the tips being farthest from the peripheral wall 31). The relationship between the areas is set as follows. That is, the area of the first inflow part A1 and the area of the second inflow part A2 are set to be approximately equal to each other. The area of each of the first and second inflow parts A1 and A2 is larger than the area of either of the third and fourth inflow parts A3 and A4. The area of the third inflow part A3 is smaller than the area of the fourth inflow part A4. For example, the area of the third inflow part A3 is set approximately half of the area of the fourth inflow part A4. As described above, in the present embodiment, the relationship of $A3<A4<A1\approx A2$ is established as the relationship of the areas of the inflow parts A1 to A4. Note that the third inflow part A3 corresponds to the "first region" of the claims, and the fourth inflow part A4 corresponds to the "second region" of the claims.

(Rib)

As shown in FIGS. 12, 13, and other figures, in the inner peripheral surface of the peripheral wall 31, a plurality of ribs protruding inward (toward the block inner peripheral wall 2E) is provided.

In each of the cylinders 2*a* to 2*d*, a pair of ribs 51*a* to 51*d* facing each other across the center of the cylinder 2 is provided in the peripheral wall 31. The ribs 51*a* to 51*d* are ribs extending in an up-and-down direction, and are positioned on a plane extending in a right-to-left direction through the centers of the cylinders 2*a* to 2*d*. Note that FIG. 13 is a diagram showing the inner peripheral surface of the intake side of the peripheral wall 31. Although the inner peripheral surface of the exhaust side of the peripheral wall 31 is not shown, the inner peripheral surface of the intake side and the inner peripheral surface of the exhaust side have substantially the same structure. The ribs 51*a* to 51*d* on the intake side have the same structure as the ribs 51*a* to 51*d* on the exhaust side corresponding thereto.

The pair of first ribs 51*a* corresponding to the first cylinder 2*a* extends from the upper end to the lower end of the front peripheral wall 140 on the plane extending in a right-to-left direction through the center of the first cylinder 2*a*.

The second ribs 51*b*, the third ribs 51*c*, and the fourth ribs 51*d* respectively corresponding to the second cylinder 2*b*, the third cylinder 2*c*, and the fourth cylinder 2*d* extend downward from the upper end of the lower peripheral wall 33. The fourth ribs 51*d* corresponding to the fourth cylinder 2*d* extend downward from the lower edge of the second guide element 39.

Figure 17:
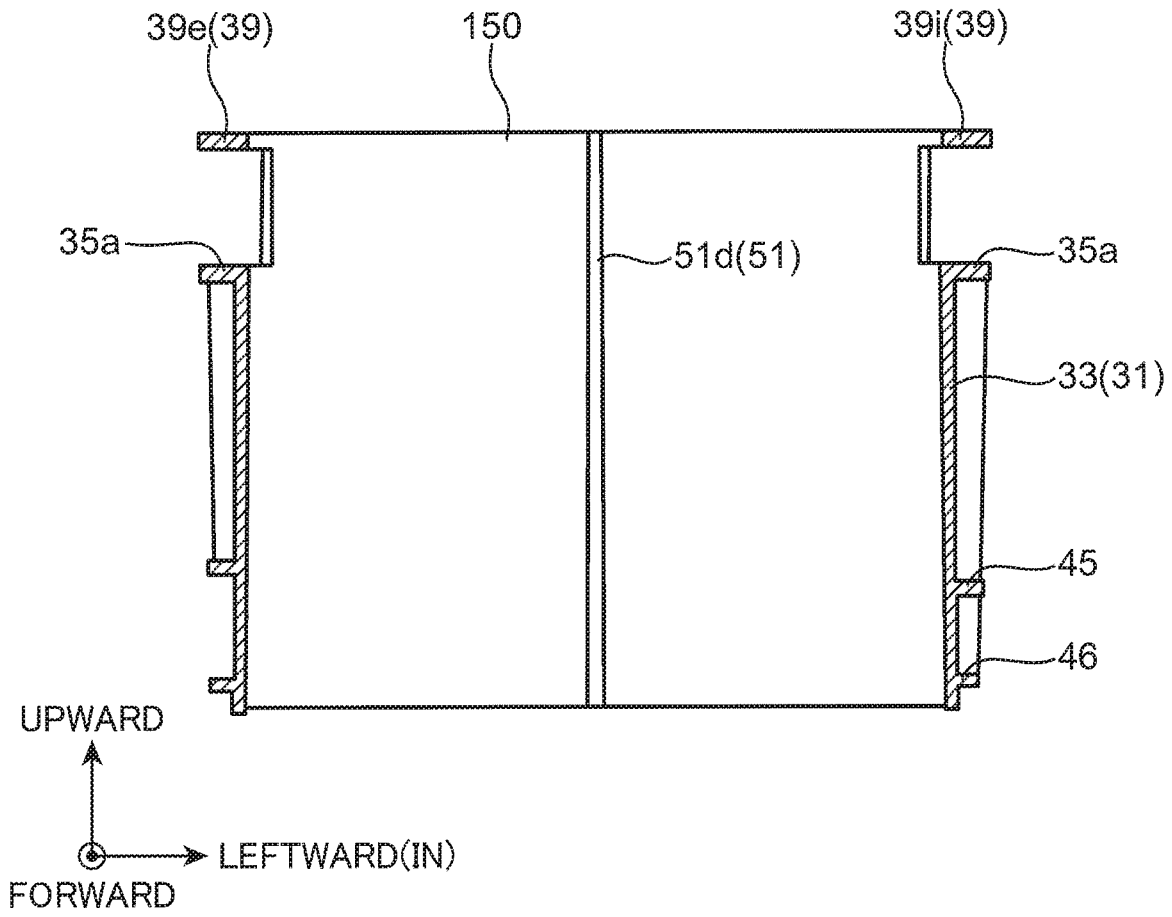
FIG. 17 is a cross-sectional view of the spacer along the line XVII-XVII of FIG. 10.

Ribs 51 extending in an up-and-down direction are also provided at the front end and the rear end of the peripheral wall 31. That is, a fifth rib 51*e* is provided at the front end of the peripheral wall 31 surrounding the first cylinder 2*a* (front peripheral wall 140), and a sixth rib 51*f* is provided at the rear end of the peripheral wall 31 surrounding the fourth cylinder 2*d* (rear peripheral wall 150). As shown in FIG. 17, which is a cross-sectional view passing through the line XVII-XVII of FIG. 10, FIG. 12, and other figures, the fifth rib 51*e* and the sixth rib 51*f* extend from the upper end to the lower end of the peripheral wall 31.

(Flange)

The spacer 30 includes a plurality of flanges in addition to the intermediate flange 35*a*.

The spacer 30 includes a pair of second flanges 42 that constitutes a part of an opening edge above the second guide element 39 (intake side and exhaust side second through holes 39*i* and 39*e*) and the upper peripheral wall 32. Each second flange 42 extends from the front end to the rear end (more accurately, a position slightly backward of the rear end) of the second guide element 39. As shown in FIG. 6, the second flange 42 extends from a vicinity of the block outer peripheral wall 10 to a vicinity of the block inner peripheral wall 2E in top view. The second flange 42 covers almost the entire upper part of the clearance between the block outer peripheral wall 10 and the block inner peripheral wall 2E in a region where the second guide element 39 are formed.

The spacer 30 includes a pair of first flanges 41 each protruding outward (toward the block outer peripheral wall 10) from the upper end of a part where the first guide element 38 (intake side and exhaust side first through holes 38*i* and 38*e*) are formed in the upper peripheral wall 32. Each first flange 41 extends over the entire first guide element 38 in a front-to-back direction. In other words, the first flange 41 is formed to extend in a front-to-back direction from a position corresponding to the rear edge of the front peripheral wall 140 to a position corresponding to the front edge of the central peripheral wall 130.

The spacer 30 includes a third flange 43 protruding outward (toward the block outer peripheral wall 10) from the upper end of the front peripheral wall 140. In top view, the third flange 43 is formed to extend forward and on the intake side from the same position as the rear end of the coolant-introducing hole 15, and to reach the same position as the front end of the intake side first through hole 38*i*.

The first flange 41 of the intake side corresponding to the intake side first through hole 38*i* extends backward continuously from the rear end of the intake side of the third flange 43. The first flange 41 of the exhaust side corresponding to the exhaust side first through hole 38*e* extends backward from a position slightly apart backward of the rear end of the exhaust side of the third flange 43.

In this way, in the present embodiment, the flanges are provided protruding outward substantially over the entire circumference of the upper end of the peripheral wall 31 surrounding the first cylinder 2*a*. As shown in FIG. 6 and other figures, the flanges (first flange 41 and third flange 43) extend as a whole to the vicinity of the block outer peripheral wall 10. Thus, almost the entire upper part of the space between the peripheral wall 31 (front peripheral wall 140) surrounding the front part of the first cylinder 2*a* and the block outer peripheral wall 10 is covered with the flanges.

Here, as described above, the bulging part 18 is formed at the front end of each of the exhaust side wall 11 and the intake side wall 12. Correspondingly, in the present embodiment, the end of the exhaust side at the front end of the third flange 43 is curved to be recessed inward along the bulging part (hereinafter referred to as an exhaust side first bulging part as appropriate) 18*e* of the front end of the exhaust side wall 11 in top view, and has a shape surrounding the exhaust side first bulging part 18*e*. Meanwhile, the end of the intake side at the front end of the third flange 43 is curved to be recessed inward along the bulging part (hereinafter referred to as an intake side first bulging part as appropriate) 18*i* of the front end of the intake side wall 12 in top view, and has a shape surrounding the intake side first bulging part 18*i*.

In the front part of the third flange 43, that is, on an upper surface of the part of the third flange 43 extending in a right-to-left direction along the front side wall 13, a plurality of regulating parts 43*a* protruding upward is provided. The regulating parts 43*a* are arranged to extend in parallel in a front-to-back direction and arranged at almost equal intervals in a right-to-left direction. The regulating parts 43*a* extend over the entire front-to-back direction of the upper front surface of the third flange 43.

As shown in FIG. 9 and other figures, the spacer 30 includes a fourth flange 44 extending in an up-and-down direction and protruding backward from the rear end of the upper peripheral wall 32. The fourth flange 44 extends from the upper end of the upper peripheral wall 32 to the intermediate flange 35*a*.

As shown in FIG. 9 and other figures, the spacer 30 includes a fifth flange 45 and a sixth flange 46 extending in the circumferential direction of the peripheral wall 31. The sixth flange 46 is a flange protruding outward (toward the block outer peripheral wall 10) from the lower end of the peripheral wall 31. The fifth flange 45 is a flange protruding outward from a position slightly above the lower end of the peripheral wall 31. The fifth and sixth flanges 45 and 46 are provided over the entire circumference of the peripheral wall 31.

As shown in FIGS. 11, 15, and other figures, the spacer 30 includes a first regulating flange 47 protruding outward from the outer peripheral surface of the intake side of a part of the lower peripheral wall 33 surrounding the second cylinder 2*b*. The first regulating flange 47 extends in an up-and-down direction between the intermediate flange 35*a* and the fifth flange 45. The first block side outlet hole 16 is provided at a position facing the lower peripheral wall 33. The first regulating flange 47 is provided backward of the first block side outlet hole 16.

As shown in FIGS. 10, 15, and other figures, the spacer 30 includes a second regulating flange 48 protruding outward from the outer peripheral surface of the exhaust side of a part of the lower peripheral wall 33 surrounding the fourth cylinder 2*d*. The second regulating flange 48 extends in an up-and-down direction between the intermediate flange 35*a* and the fifth flange 45. The second block side outlet hole 17 is provided at a position facing the lower peripheral wall 33. The second regulating flange 48 is provided backward of the second block side outlet hole 17.

Furthermore, as shown in FIGS. 9, 12, and other figures, the spacer 30 includes reinforcing ribs 52 each extending in an up-and-down direction at a part of the upper peripheral wall 32 facing each inter-bore part 2*f* and protruding outward from the outer peripheral surface of the upper peripheral wall 32. Each reinforcing rib 52 extends from a vicinity of the upper end of the upper peripheral wall 32 to the intermediate flange 35*a*.

(4) Flow of the Coolant in the Water Jacket

Figure 18:
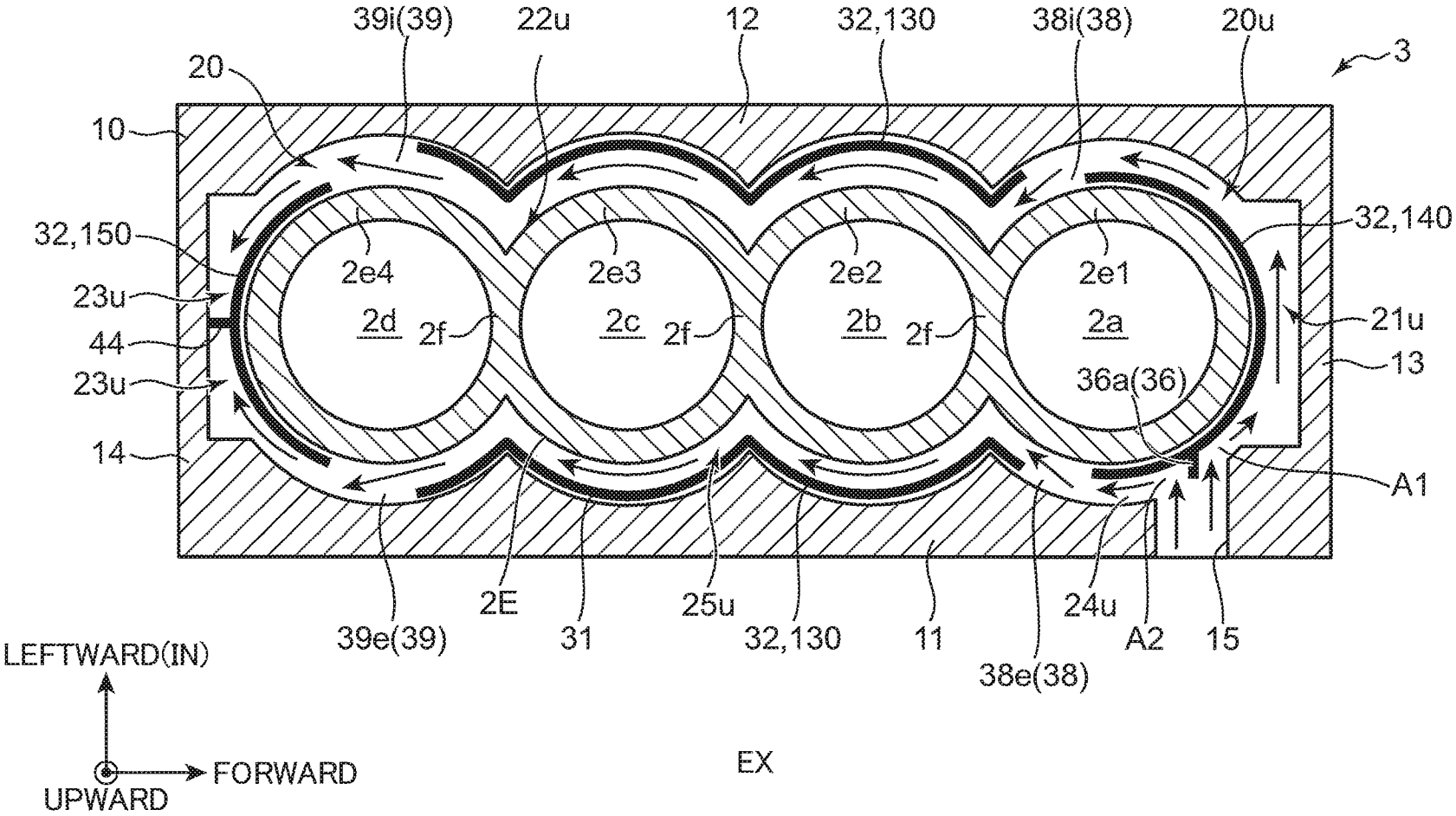
FIG. 18 is a diagram schematically showing a flow of a coolant in an upper region of a water jacket.
Figure 19:
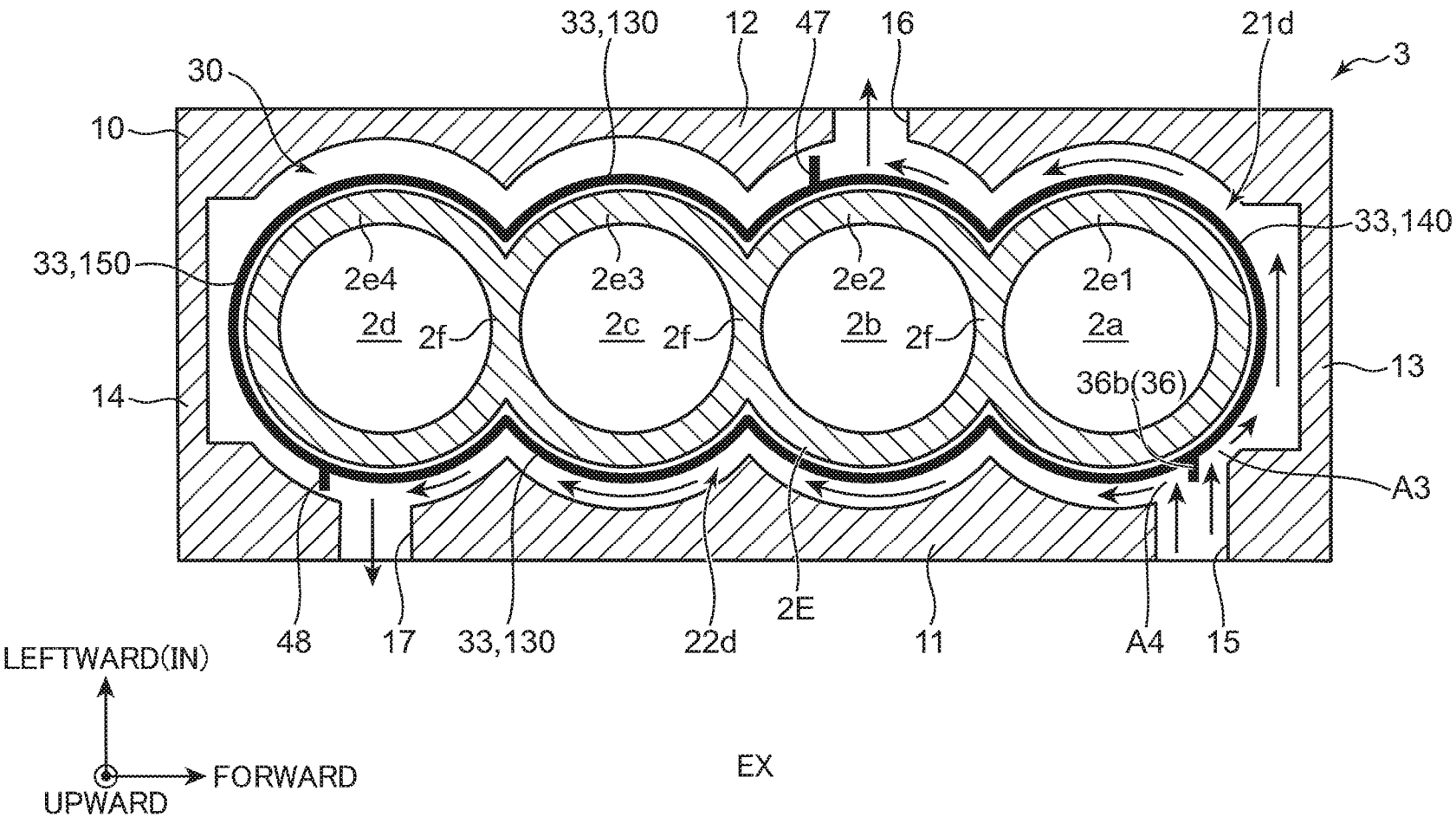
FIG. 19 is a diagram schematically showing the flow of the coolant in a lower region of the water jacket.

A flow of the coolant in the water jacket 20 will be described. FIG. 18 is a diagram schematically showing the flow in the upper region of the water jacket 20 (space above the dividing wall 35 in the water jacket 20). FIG. 19 is a diagram schematically showing the flow in the lower region of the water jacket 20 (space below the dividing wall 35 in the water jacket 20).

The coolant discharged from the water pump 60 is introduced into the water jacket 20 through the coolant-introducing hole 15. At this time, the coolant flows separately into each of the first inflow part A1 to the fourth inflow part A4. The coolant having flowed into each of the inflow parts A1 to A4 flows as follows.

(Coolant Having Flowed into the First Inflow Part A1 and the Second Inflow Part A2)

The coolant having flowed into the first inflow part A1 formed above the intermediate flange 35*a* and forward of the distribution wall 36 circulates through the upper region of the water jacket 20.

That is, the coolant having flowed into the first inflow part A1 first passes through a part of the passage defined between the peripheral wall 31 above the intermediate flange 35*a* (upper peripheral wall 32) and the block outer peripheral wall 10, i.e., through a part from the coolant-introducing hole 15 to the intake side first through hole 38*i* via the front side of the front end of the upper peripheral wall 32 (hereinafter referred to as a first upper passage 21*u* as appropriate), and then moves to the intake side first through hole 38*i*.

In the intake side first through hole 38*i*, the intermediate flange 35*a* and the step 35*b* are connected to each other. In the region backward of the intake side first through hole 38*i*, the space inside the peripheral wall 31 is vertically divided by the step 35*b*. The upper space of this region (space above the step 35*b*) is divided by the central peripheral wall 130 such that the flow channel area is larger in the inside than in the outside. With this configuration, most of the coolant that has reached the intake side first through hole 38*i* flows into an inner passage above the step 35*b* and having a larger flow channel area, that is, a passage defined between the intake side part of the upper peripheral wall 32 of the central peripheral wall 130 and the block inner peripheral wall 2E (hereinafter referred to as a second upper passage 22*u* as appropriate). Then, the coolant moves backward in the second upper passage 22*u* and moves to the intake side second through hole 39*i*.

In the intake side second through hole 39*i*, the step 35*b* and the intermediate flange 35*a* are connected to each other. In the region backward of the intake side second through hole 39*i*, the space outside the peripheral wall 31 is divided vertically by the intermediate flange 35*a*. The upper space of this region (space above the intermediate flange 35*a*) is divided by the rear peripheral wall 150 such that the flow channel area is larger in the outside than in the inside. With this configuration, most of the coolant that has reached the intake side second through hole 39*i* flows into an outer passage above the intermediate flange 35*a* and having a larger flow channel area, that is, a passage defined between the upper peripheral wall 32 of the rear peripheral wall 150 and the block outer peripheral wall 10 (hereinafter referred to as a third upper passage 23*u* as appropriate). The third upper passage 23*u* communicates with the first head side jacket 4*a*, and the coolant that has reached the third upper passage 23*u* flows into the first head side jacket 4*a*.

The coolant having flowed into the second inflow part A2 formed above the intermediate flange 35*a* and backward of the distribution wall 36 circulates through the upper region of the water jacket 20.

That is, the coolant having flowed into the second inflow part A2 first passes through a part of the passage defined between the peripheral wall 31 above the intermediate flange 35*a* (upper peripheral wall 32) and the block outer peripheral wall 10, i.e., through a part extending backward from the second inflow part A2 to the exhaust side first through hole 38*e* (hereinafter referred to as a fourth upper passage 24*u* as appropriate), and then moves to the exhaust side first through hole 38*e*.

In the exhaust side first through hole 38*e*, the intermediate flange 35*a* and the step 35*b* are connected to each other. In the region backward of the exhaust side first through hole 38*e*, the space inside the peripheral wall 31 is vertically divided by the step 35*b*. The upper space of this region (space above the step 35*b*) is divided by the central peripheral wall 130 such that the flow channel area is larger in the inside than in the outside. With this configuration, in a similar manner to the intake side, most of the coolant that has reached the exhaust side first through hole 38*e* flows into an inner passage above the step 35*b* and having a larger flow channel area, that is, a passage defined between the exhaust side part of the upper peripheral wall 32 of the central peripheral wall 130 and the block inner peripheral wall 2E (hereinafter referred to as a fifth upper passage 25*u* as appropriate). Then, the coolant moves backward in the fifth upper passage 25*u* and reaches the exhaust side second through hole 39*e*.

In a similar manner to the intake side, most of the coolant that has reached the exhaust side second through hole 39*e* flows into an outer passage having a relatively large flow channel area, that is, the third upper passage 23*u*, and then flows into the first head side jacket 4*a*.

Not that the third upper passage 23*u* is divided into the intake side and the exhaust side by the fourth flange 44. Therefore, the coolant flowing from the first inflow part A1 changes its direction at an intake side part of the fourth flange 44 in the third upper passage 23*u*, and flows into the first head side jacket 4*a*. Meanwhile, the coolant flowing from the second inflow part A2 changes its direction at an exhaust side part of the fourth flange 44 in the third upper passage 23*u*, and flows into the first head side jacket 4*a*.

In this way, the coolant having flowed into the first inflow part A1 and the second inflow part A2 passes through the passage along the upper peripheral wall 32, that is, the passage defined above the dividing wall 35 in the water jacket 20, and is introduced into the first head side jacket 4*a*. In other words, the first to fifth upper passages 21*u* to 25*u* and the guide elements 38 and 39 through which the coolant having flowed into the first inflow part A1 and the second inflow part A2 passes constitute a part of the main passage L10. Hereinafter, as appropriate, the space defined above the dividing wall 35 in the water jacket 20 is referred to as an upper passage 20*u*.

As described above, the coolant circulating through the upper passage 20*u* passes outside the peripheral wall 31 in parts along the front peripheral wall 140 and the rear peripheral wall 150. In a part along the central peripheral wall 130, the coolant passes inside the peripheral wall 31. Thus, the coolant does not come in direct contact with the upper part of each of the front part of the first cylinder wall 2*e*1 and the rear part of the fourth cylinder wall 2*e*4. Meanwhile, the coolant comes in direct contact with the upper part of each inter-bore part 2*f* and the upper parts of the second cylinder wall 2*e*2 and the third cylinder wall 2*e*3.

In addition, in the present embodiment, the third flange 43, the first rib 51*a*, and the fifth rib 51*e* ensure that direct contact between the front part of the first cylinder wall 2*e*1 and the coolant is avoided.

Specifically, in the vicinity of the first and second inflow parts A1 and A2, a part of the coolant flows upward following a collision against the front peripheral wall 140 facing the inflow parts A1 and A2. In contrast, in the present embodiment, as described above, the upper part of the space between the coolant-introducing hole 15 and the front peripheral wall 140 is covered with the third flange 43. Therefore, in the vicinity of the first and second inflow parts A1 and A2, the coolant is prevented from going beyond the upper end of the front peripheral wall 140 and flowing into the inside of the front peripheral wall 140 (clearance between the front peripheral wall 140 and the first cylinder wall 2*e*1), and direct contact of the coolant with the front part of the first cylinder wall 2*e*1 is avoided.

In the first upper passage 21*u* along the front peripheral wall 140, since the flow channel area is reduced by the exhaust side first bulging part 18*e* and the intake side first bulging part 18*i*, the speed of the coolant having flowed vigorously from the coolant-introducing hole 15 into the first inflow part A1 is further increased when passing by the first bulging parts 18*e* and 18*i*. With this configuration, the flow of the coolant is turbulent on the downstream side of the first bulging parts 18*e* and 18*i*, and the flow direction of some of the coolant is upward. In contrast, in the present embodiment, also on the downstream side of the first bulging parts 18*e* and 18*i*, the upper part of the space between the front peripheral wall 140 and the block outer peripheral wall 10 is covered with the third flange 43. Therefore, it is avoided by the third flange 43 that the coolant goes beyond the upper end of the front peripheral wall 140 and flows into the inside of the front peripheral wall 140.

There is a possibility that a part of the coolant passes through the first guide element 38 (intake side first through hole 38*i* and exhaust side first through hole 38*e*) and then turns forward to enter the inside of the front peripheral wall 140. In contrast, in the present embodiment, the inner peripheral surface of the front peripheral wall 140 is divided in the circumferential direction by the first rib 51*a* and the fifth rib 51*e*. In other words, a configuration is employed in which the inner peripheral surface of the front peripheral wall 140 is not a continuous peripheral surface by providing the first rib 51*a* and the fifth rib 51*e*. Therefore, it is unlikely that a coolant flow along the inner peripheral surface of the front peripheral wall 140 is formed, and it is avoided that a part of the coolant having reached the first guide element 38 enters the inside of the front peripheral wall 140.

In the present embodiment, the sixth rib 51*f* ensures that direct contact between the rear part of the fourth cylinder wall 2*e*4 and the coolant is avoided.

Specifically, in a similar manner to the fifth rib 51*e* described above, the inner peripheral surface of the rear peripheral wall 150 is divided by the sixth rib 51*f*. With this configuration, it is unlikely that a coolant flow along the inner peripheral surface of the rear peripheral wall 150 is formed, and it is avoided that a part of the coolant having passed through the second guide element 39 enters the inside of the rear peripheral wall 150 to come into direct contact with the fourth cylinder wall 2*e*4.

Furthermore, in the present embodiment, it is avoided by the second to fourth ribs 51*b* to 51*d* provided on the lower peripheral wall 33 that the coolant circulating through the second upper passage 22*u* and the fifth upper passage 25*u* leaks below the step 35*b*.

Specifically, if the inner peripheral surface of the lower peripheral wall 33 is continuous, as shown by a broken line in FIG. 13, a downward flow is easily formed along the inner peripheral surface from the second upper passage 22*u*. This means that the coolant is likely to leak downward from the second upper passage 22*u*. In contrast, in the present embodiment, the lower peripheral wall 33 below the second upper passage 22*u*, that is, the inner peripheral surface of the lower peripheral wall 33 facing the intake side surface of the second to fourth cylinder walls 2*e*2 to 2*e*4 is divided by the second to fourth ribs 51*b* to 51*d* of the intake side. Therefore, it is avoided that the flow as described above is formed, that is, that the coolant in the second upper passage 22*u* leaks downward.

This also applies to the fifth upper passage 25*u*. That is, the inner peripheral surface of the lower peripheral wall 33 below the fifth upper passage 25*u* is divided by the second to fourth ribs 51*b* to 51*d* of the exhaust side. Therefore, it is avoided that a downward flow is formed along the inner peripheral surface, that is, that the coolant in the fifth upper passage 25*u* leaks downward.

(Coolant Having Flowed into the Third Inflow Part A3 and the Fourth Inflow Part A4)

The coolant having flowed into the third inflow part A3 formed below the intermediate flange 35*a* and forward of the distribution wall 36 circulates through the lower region of the water jacket 20.

That is, the coolant having flowed into the third inflow part A3 passes through the passage defined between the peripheral wall 31 below the intermediate flange 35*a* (lower peripheral wall 33) and the block outer peripheral wall 10, moves forward from the third inflow part A3, and then wraps around to the intake side. The coolant having wrapped around to the intake side passes through the passage defined between the lower peripheral wall 33 on the intake side and the block outer peripheral wall 10, and moves backward. As described above, the first regulating flange 47 is provided backward of the first block side outlet hole 16 on the intake side surface of the lower peripheral wall 33. Therefore, the first regulating flange 47 regulates movement of the coolant backward of the first regulating flange 47, and the coolant is introduced into the first block side outlet hole 16. Then, the coolant passes through the first block side outlet hole 16 and is led out of the water jacket 20.

In this way, the coolant having flowed into the third inflow part A3 passes through a part of the lower region of the water jacket 20, and is led out to the first block side outlet hole 16. The passage for the coolant, that is, a passage from the third inflow part A3 to the first regulating flange 47 through the front side of the front end of the lower peripheral wall 33 in the space between the lower peripheral wall 33 and the block outer peripheral wall 10 (hereafter referred to as a first lower passage 21*d* as appropriate) constitutes part of the first auxiliary passage L20.

The coolant having flowed into the fourth inflow part A4 formed below the intermediate flange 35*a* and backward of the distribution wall 36 circulates through the lower region of the water jacket 20.

That is, the coolant having flowed into the fourth inflow part A4 passes through the passage defined between the peripheral wall 31 below the intermediate flange 35*a* (lower peripheral wall 33) and the block outer peripheral wall 10, and moves backward. As described above, the second regulating flange 48 is provided at a position backward of the second block side outlet hole 17 on the exhaust side surface of the lower peripheral wall 33. Therefore, the second regulating flange 48 regulates movement of the coolant backward of the second regulating flange 48, and the coolant is introduced into the second block side outlet hole 17. Then, the coolant passes through the second block side outlet hole 17 and is led out of the water jacket 20.

In this way, the coolant having flowed into the fourth inflow part A4 passes through a part of the lower region of the water jacket 20, and is led out to the second block side outlet hole 17. The passage for the coolant, that is, a passage from the fourth inflow part A4 to the second regulating flange 48 through the exhaust side of the lower peripheral wall 33 in the space between the lower peripheral wall 33 and the block outer peripheral wall 10, (hereafter referred to as a second lower passage 22*d* as appropriate) constitutes part of the second auxiliary passage L30.

(5) Effects and the Like

As described above, the present embodiment employs a configuration in which the region facing the coolant-introducing hole 15 in the peripheral wall 31 of the spacer 30, in other words, the space between the inner opening of the coolant-introducing hole 15 and the peripheral wall 31 is divided into the first to fourth inflow parts A1 to A4 by the dividing wall 35 and the distribution wall 36, and the coolant discharged from the water pump 60 is introduced separately into the inflow parts A1 to A4 to circulate through different passages. Therefore, the block inner peripheral wall 2E (first to fourth cylinder walls 2*e*1 to 2*e*4), the EGR gas, and the lubricant can be appropriately cooled.

Specifically, in the present embodiment, the dividing wall 35 extending in the circumferential direction is provided in the region facing the coolant-introducing hole 15 in the peripheral wall 31, and the water jacket 20 is divided into the upper passage 20*u* and the lower passages 21*d* and 22*d* by the dividing wall 35. This makes it possible to avoid that the coolant flows unevenly upward or downward, and to appropriately distribute the coolant to the upper passage 20*u* and the lower passages 21*d* and 22*d*.

In particular, in the present embodiment, the upper passage 20*u* allows the coolant to circulate so as to come in direct contact with the second cylinder wall 2*e*2, the third cylinder wall 2*e*3, and the plurality of (three) inter-bore parts 2*f*, and not to come in direct contact with the front part of the first cylinder wall 2*e*1 and the rear part of the fourth cylinder wall 2*e*4. The lower passages 21*d* and 22*d* allow the coolant to circulate so as not to come in direct contact with the first to fourth cylinder walls 2*e*1 to 2*e*4. This makes it possible to implement appropriate cooling according to temperature conditions of the first to fourth cylinders 2*a* to 2*d*.

That is, since there are other cylinders on both sides of the second cylinder 2*b*, a wall part corresponding to the second cylinder 2*b* in the block inner peripheral wall 2E, that is, the second cylinder wall 2*e*2 is likely to reach a high temperature. Similarly, since there are other cylinders on both sides of the third cylinder 2*c*, a wall part corresponding to the third cylinder 2*c* in the block inner peripheral wall 2E, that is, the third cylinder wall 2*e*3 is likely to reach a high temperature. Moreover, the inter-bore part 2*f*, which receives combustion energy from the two cylinders, is likely to reach a high temperature. In particular, upper parts of the second cylinder wall 2e2, the third cylinder wall 2e3, and the inter-bore part 2f, which are close to the combustion chambers, are likely to reach a higher temperature. In the present embodiment, such a part that is likely to reach a high temperature can be reliably cooled by direct contact with the coolant.

Meanwhile, the coolant does not come in direct contact with other parts that are unlikely to reach a high temperature, specifically, the front part of the first cylinder wall 2e1, the rear part of the fourth cylinder wall 2e4, and lower parts of the first to fourth cylinder walls 2e1 to 2e4, making it possible to avoid excessive cooling of the parts that are unlikely to reach a high temperature. In particular, in the present embodiment, auto-ignition combustion is performed in the combustion chambers. Therefore, there is a possibility that, if the block inner peripheral wall 2E (first to fourth cylinder walls 2e1 to 2e4) is excessively cooled, the temperature in the combustion chambers becomes too low and auto-ignition combustion is not stabilized. In contrast, according to the present embodiment that can avoid the block inner peripheral wall 2E from being excessively cooled, the stability of auto-ignition combustion can be increased.

Here, in order to appropriately cool the second cylinder wall 2e2, the third cylinder wall 2e3, and the inter-bore part 2f, it is necessary to bring a sufficient amount of coolant into contact with both the intake side part and the exhaust side part thereof. As described above, however, when the coolant-introducing hole 15 is formed at one end in the cylinder row direction of the cylinder block 3, there is a possibility that the coolant introduced from the coolant-introducing hole 15 to the water jacket 20 flows unevenly on the first side (the side close to the coolant-introducing hole 15) in the circumferential direction. In particular, in the present embodiment, the coolant-introducing hole 15 is shifted forward of the center of the first cylinder 2a in a front-to-back direction, and the peripheral wall 31 facing the coolant-introducing hole 15 is curved toward the front side and the intake side (curved such that a part of the peripheral wall 31 is positioned closer to the intake side as the part is closer to the front). Therefore, the coolant introduced into the water jacket 20 in a direction from the coolant-introducing hole 15 toward the intake side is likely to move forward, and a flow amount of the coolant is likely to lean to forward, that is, to the first side in the circumferential direction of the peripheral wall 31.

In contrast, in the present embodiment, the part where the coolant is introduced from the coolant-introducing hole 15 into the upper passage 20u is divided by the distribution wall 36 (upper distribution wall 36a) extending in an up-and-down direction into the first inflow part A1 and the second inflow part A2. This makes it possible to avoid the coolant introduced from the coolant-introducing hole 15 into the water jacket 20 from flowing unevenly on the first side in the circumferential direction, to circulate a sufficient amount of coolant to each of the intake side and the exhaust side of the upper passage 20u, and to appropriately cool each of the intake side and the exhaust side of the second cylinder wall 2e2, the third cylinder wall 2e3, and the inter-bore part 2f.

Furthermore, in the present embodiment, the part where the coolant is introduced from the coolant-introducing hole 15 into the lower passages 21d and 22d is also divided by the distribution wall 36 (lower distribution wall 36b) extending in an up-and-down direction into the third inflow part A3 and the fourth inflow part A4. Therefore, distribution of the coolant to the oil cooler 63 and the EGR cooler 64 can be optimized. That is, by adjusting the amount of coolant introduced from the third inflow part A3 to the first lower passage 21d and the amount of coolant introduced from the fourth inflow part A4 to the second lower passage 22d, an appropriate amount of coolant can be introduced into the oil cooler 63 into which the coolant is introduced via the first lower passage 21d and the EGR cooler 64 into which the coolant is introduced via the second lower passage 22d. Therefore, the lubricant and the EGR gas can be appropriately cooled by the coolant introduced into each of the coolers 63 and 34.

In this way, in the present embodiment, the appropriate amount of coolant can be distributed to the upper region and the lower region of the water jacket 20, and furthermore, the appropriate amount of coolant can be distributed to the first side and the second side of the circumferential direction in each region. Therefore, the upper region and the lower region of the water jacket 20 can be used as an effective coolant circulation channel, and generation of a dead space in the water jacket 20 can be avoided.

In the present embodiment, by using the lower passages 21d and 22d as passages for introducing the coolant into the oil cooler 63 and the EGR cooler 64, respectively, the coolant having a relatively low and stable temperature can be introduced into the coolers 63 and 64. That is, the lower passages 21d and 22d are provided at positions relatively far from the combustion chambers. The coolant circulating through the lower passages 21d and 22d does not come in direct contact with the block inner peripheral wall 2E. Therefore, the coolant circulating through the lower passages 21d and 22d is unlikely to be affected by the combustion chambers or the block inner peripheral wall 2E, and the temperature is maintained at a relatively low temperature. Therefore, by introducing such a coolant into the oil cooler 63 and the EGR cooler 64, the lubricant and the EGR gas can be reliably cooled in the coolers 63 and 64, and temperature fluctuation of the lubricant and the EGR gas can be suppressed.

In the present embodiment, as described above, the area of the third inflow part A3 is smaller than the area of the fourth inflow part A4. This makes it possible to prevent the coolant from being introduced unevenly to the third inflow part A3, and to more reliably introduce the appropriate amount of coolant to the coolers 63 and 64. That is, as described above, in the present embodiment, since the coolant flowing from the coolant-introducing hole 15 into the water jacket 20 is likely to move forward, the amount of coolant introduced in the third inflow part A3 on the front side is likely to be larger than the amount introduced in the fourth inflow part A4 on the rear side. In contrast, since the areas of the inflow parts A3 and A4 are set as described above, it is possible to avoid that the coolant introduced into the third inflow part A3 becomes excessively large, and that the coolant introduced into the fourth inflow part A4 becomes excessively small.

(6) Modification

The embodiment has described a case where the heat exchanger into which the coolant circulating through the lower passages 21d and 22d is introduced includes the ATF warmer 62, the oil cooler 63, the EGR cooler 64, and the heater 65. However, the heat exchanger to be connected to the lower passages 21d and 22d is not limited to these devices.

The embodiment has described a case where auto-ignition combustion is performed in the combustion chambers, but the combustion mode is not limited to this case.

(7) Conclusion

The embodiment and the modification described above are summarized as follows.

An engine cooling structure is a structure for cooling an engine body including a plurality of cylinders arranged in a row by using a coolant, and includes: a cylinder block including: a block inner peripheral wall defining the plurality of cylinders; and a block outer peripheral wall surrounding the block inner peripheral wall to define a water jacket through which the coolant circulates between the block outer peripheral wall and the block inner peripheral wall; and a spacer housed in the water jacket. The block outer peripheral wall includes a coolant inlet configured to introduce the coolant from a water pump into the water jacket at one end in a cylinder row direction. The spacer includes: a peripheral wall surrounding the block inner peripheral wall to divide the water jacket into an inner space near the plurality of cylinders and an outer space far from the plurality of cylinders; a dividing wall provided along a circumferential direction of the peripheral wall to divide the peripheral wall into an upper peripheral wall and a lower peripheral wall below the upper peripheral wall; and a distribution wall provided in a part facing the coolant inlet in the peripheral wall in order to distribute the coolant introduced from the coolant inlet into the water jacket to a first side and a second side of the circumferential direction of the peripheral wall, the distribution wall protruding outward from the peripheral wall and extending in an up-and-down direction. The dividing wall includes a part protruding outward from the peripheral wall at a position between a lower end and an upper end of the coolant inlet. The distribution wall includes: an upper distribution wall extending upward from an upper surface of the dividing wall; and a lower distribution wall extending downward from a lower surface of the dividing wall.

In the cooling structure, a part of the dividing wall facing the coolant inlet is disposed between the lower end and the upper end of the coolant inlet in the up-and-down direction. The dividing wall distributes the coolant introduced from the coolant inlet into the water jacket to flow in both an upper region and a lower region of the dividing wall. Therefore, the substantially entire water jacket in the up-and-down direction can be effectively used as a passage through which the coolant circulates, and the appropriate amount of coolant can be circulated in each of the upper region and the lower region of the dividing wall.

Furthermore, the distribution wall including the upper distribution wall extending upward from the dividing wall and the lower distribution wall extending downward from the dividing wall is formed in a part of the peripheral wall of the spacer facing the coolant inlet. Therefore, the coolant introduced from the coolant inlet into the water jacket can be distributed to the first side and the second side of the circumferential direction of the peripheral wall of the spacer by the distribution wall (upper distribution wall and lower distribution wall). In the circumferential direction as well, the substantially entire water jacket can be effectively used as a passage through which the coolant circulates.

In particular, in the cooling structure, since the coolant inlet is provided at the end of the cylinder row direction of the block outer peripheral wall, there is a possibility that the coolant introduced from the coolant inlet into the water jacket flows unevenly on the first side in the circumferential direction. The distribution wall is effective in suppressing such unevenness of the coolant. That is, with the cooling structure in which the distribution wall is provided on the peripheral wall of the spacer, while the coolant inlet is provided at the end of the cylinder row direction, the appropriate amount of coolant can be distributed to each of the first side and the second side of the circumferential direction of the water jacket.

As described above, with the cooling structure, the appropriate amount of coolant can be circulated on both sides of the up-and-down direction and the circumferential direction of the water jacket, and the entire water jacket can be effectively used as a circulation channel for the coolant.

In the cooling structure, preferably, the upper peripheral wall includes guide element configured to guide the coolant. When one of the plurality of cylinders excluding cylinders at both ends of the cylinder row is a central cylinder, the guide element guides the coolant such that the coolant circulates between a wall part corresponding to the central cylinder in the block inner peripheral wall and the upper peripheral wall, and the coolant circulates between both end parts in the cylinder row direction of the upper peripheral wall and the block outer peripheral wall. The lower peripheral wall divides the water jacket such that the coolant circulates between the lower peripheral wall and the block outer peripheral wall over an entire circumference of the lower peripheral wall.

With this configuration, the coolant circulates between the upper peripheral wall and the block outer peripheral wall around the cylinders at both ends of the cylinder row (hereinafter also referred to as "both-end cylinders"), and the coolant circulates between the upper peripheral wall and the block inner peripheral wall around the central cylinder excluding the both-end cylinders. Therefore, it is possible to implement appropriate cooling according to temperature conditions of the central cylinder and the both-end cylinders.

That is, since the central cylinder is adjacent to other cylinders on both sides, the wall part corresponding to the central cylinder in the block inner peripheral wall (hereinafter also referred to as "central cylinder wall") is likely to reach a high temperature. In particular, the upper part of the central cylinder wall, which is close to the combustion chamber, is likely to reach a higher temperature. Meanwhile, the wall parts corresponding to the both-end cylinders in the block inner peripheral wall (hereinafter also referred to as "both-end cylinder walls") are likely to be lower in temperature than the central cylinder wall. In contrast, with the above configuration, it is possible to appropriately cool the upper part of the central cylinder wall, which is likely to reach a high temperature, by bringing the coolant into direct contact with the upper part of the central cylinder wall. Also, it is possible to appropriately keep warm around the combustion chambers of the both-end cylinders by suppressing direct contact of the coolant with the upper parts of the both-end cylinder walls. Therefore, the combustion chamber of each cylinder can be set at an appropriate temperature.

With the above configuration, since the coolant circulates between the lower peripheral wall and the block outer peripheral wall over the entire circumference of the lower peripheral wall, it is possible to prevent the lower part of the block inner peripheral wall, which is relatively far from the combustion chambers and is unlikely to reach a high temperature, from being excessively cooled by the coolant.

Moreover, since the peripheral wall of the spacer includes the dividing wall, while the circulation channel for the coolant differs between the upper region and the lower region of the water jacket as described above, the amount of coolant supplied to each channel can be adjusted appropriately by the dividing wall.

When one of the cylinders at a first end of the cylinder row is a first end cylinder and one of the cylinders at a second end of the cylinder row is a second end cylinder, and a direction orthogonal to the cylinder row direction is a width direction, the guide element may include: two first through holes facing a wall part corresponding to the first end cylinder in the block inner peripheral wall, the two first through holes being formed at two locations of the upper peripheral wall facing each other in the width direction; and two second through holes facing a wall part corresponding to the second end cylinder in the block inner peripheral wall, the two second through holes being formed at two locations of the upper peripheral wall facing each other in the width direction. In this case, the coolant inlet is preferably provided at a position shifted to the first end side in the cylinder row direction from the two first through holes.

With this configuration, with a simple configuration in which a plurality of through holes is formed in the upper peripheral wall and the coolant inlet is disposed to have a specified positional relationship with the through holes, it is possible to implement the coolant circulation form described above that relatively increases the degree of cooling for the central cylinder (that is, a form to circulate the coolant between the upper peripheral wall and the block outer peripheral wall around the first end cylinder and the second end cylinder, and to circulate the coolant between the upper peripheral wall and the block inner peripheral wall around the central cylinder).

Preferably, the cylinder block includes coolant exit provided at a position facing the lower peripheral wall, the coolant exit being configured to lead the coolant in the water jacket outside the cylinder block. The coolant exit is connected to a heat exchanger provided outside the engine body.

With this configuration, the space between the lower peripheral wall and the block outer peripheral wall can be used effectively as part of the passage for supplying the coolant to the heat exchanger. Moreover, since the lower peripheral wall is relatively far from the combustion chambers, the temperature fluctuation of the combustion chambers has little effect on the coolant circulating around the lower peripheral wall. Therefore, the coolant having a relatively stable temperature can be supplied to the heat exchanger.

The coolant exit may include a first exit and a second exit provided at positions different from each other in a circumferential direction of the lower peripheral wall. In this case, it is preferable that the first exit and the second exit are respectively connected to different heat exchangers.

With this configuration, out of the space between the lower peripheral wall and the block outer peripheral wall, a part from the distribution wall to the first exit and a part from the distribution wall to the second exit can be used as part of the passages for supplying the coolant to heat exchangers different from each other. Therefore, it is possible to appropriately supply the coolant to each heat exchanger while effectively using the space in the water jacket.

The heat exchanger connected to the first exit may include an oil cooler configured to cool a lubricant to be supplied to the engine body, and the heat exchanger connected to the second exit may include an EGR cooler configured to cool an EGR gas that is an exhaust gas recirculated to an intake air to be introduced into the engine body out of an exhaust gas discharged from the engine body.

With this configuration, the space between the lower peripheral wall and the block outer peripheral wall (lower space of the water jacket) can be used effectively as part of the passage for supplying the coolant to the EGR cooler and the oil cooler. Moreover, since the space between the lower peripheral wall and the block outer peripheral wall is away from the combustion chambers in both the up-and-down direction and the radial direction of the cylinder, the coolant circulating in the space is maintained at a relatively low temperature. Therefore, by supplying the low-temperature coolant to the EGR cooler and the oil cooler, the coolers can reliably cool the EGR gas and the lubricant.

When one of the cylinders at the first end of the cylinder row is the first end cylinder, the coolant inlet may face a region that is one region of the wall part corresponding to the first end cylinder in the block inner peripheral wall, the region being shifted to the first end side from a central part of the cylinder row direction of the wall part. In this case, out of a plurality of regions obtained by dividing the region facing the coolant inlet in the peripheral wall by the dividing wall and the distribution wall, when a region positioned below the dividing wall and on the first end side in the cylinder row direction from the lower distribution wall is a first region and a region positioned below the dividing wall and on a second end side in the cylinder row direction from the lower distribution wall is a second region, the lower distribution wall is preferably disposed at a position such that an area of the first region is smaller than an area of the second region.

With this configuration, when the coolant inlet is provided to face the wall part corresponding to the first end cylinder in the block inner peripheral wall (hereinafter referred to as "first end cylinder wall"), unevenness of the coolant resulting from the position of the coolant inlet can be suppressed.

That is, with the above configuration, since the region of the first end cylinder wall shifted to the first end side from the central part thereof in the cylinder row direction faces the coolant inlet, the coolant introduced from the coolant inlet into the water jacket is likely to flow toward the first end side in the cylinder row direction. Meanwhile, with the above configuration, out of the region facing the coolant inlet in the peripheral wall of the spacer, the area of the first region that introduces the coolant downward and to the first end side in the cylinder row direction is smaller than the area of the second region that introduces the coolant downward and to the second end side in the cylinder row direction. Therefore, in the space between the lower peripheral wall and the block outer peripheral wall, it is possible to suppress the coolant introduced from the coolant inlet from being uneven on the first end side in the cylinder row direction.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An engine cooling structure for cooling an engine body including a plurality of cylinders arranged in a row by using a coolant, the engine cooling structure comprising:

a cylinder block including: a block inner peripheral wall defining the plurality of cylinders; and a block outer peripheral wall surrounding the block inner peripheral wall to define a water jacket through which the coolant circulates between the block outer peripheral wall and the block inner peripheral wall; and a spacer housed in the water jacket, wherein the block outer peripheral wall includes a coolant inlet configured to introduce the coolant from a water pump into the water jacket at one end in a cylinder row direction, the spacer includes:

a peripheral wall surrounding the block inner peripheral wall to divide the water jacket into an inner space near the plurality of cylinders and an outer space far from the plurality of cylinders;

a dividing wall provided along a circumferential direction of the peripheral wall to divide the peripheral wall into an upper peripheral wall and a lower peripheral wall below the upper peripheral wall; and a distribution wall provided in a part facing the coolant inlet of the peripheral wall in order to distribute the coolant introduced from the coolant inlet into the water jacket to a first side and a second side in the circumferential direction of the peripheral wall, the distribution wall protruding outward from the peripheral wall and extending in an up-and-down direction, the dividing wall includes a part protruding outward from the peripheral wall at a position between a lower end and an upper end of the coolant inlet, and the distribution wall includes: an upper distribution wall extending upward from an upper surface of the dividing wall; and a lower distribution wall extending downward from a lower surface of the dividing wall, each of the upper distribution wall and the lower distribution wall including a part protruding outward from the peripheral wall at a position between a first end and a second end of the coolant inlet in the cylinder row direction.

2. The engine cooling structure according to claim 1, wherein the upper peripheral wall includes a guide element configured to guide the coolant, when one of the plurality of cylinders excluding cylinders at both ends of a cylinder row is a central cylinder, the guide element guides the coolant such that the coolant circulates between a wall part corresponding to the central cylinder in the block inner peripheral wall and the upper peripheral wall, and the coolant circulates between both end parts in the cylinder row direction of the upper peripheral wall and the block outer peripheral wall, and the lower peripheral wall divides the water jacket such that the coolant circulates between the lower peripheral wall and the block outer peripheral wall over an entire circumference of the lower peripheral wall.

3. The engine cooling structure according to claim 2, wherein when one of the plurality of cylinders at a first end of the cylinder row is a first end cylinder and one of the plurality of cylinders at a second end of the cylinder row is a second end cylinder, and a direction orthogonal to the cylinder row direction is a width direction, the guide element includes: two first through holes facing a first wall part corresponding to the first end cylinder in the block inner peripheral wall, the two first through holes being formed at two locations of the upper peripheral wall facing each other in the width direction; and two second through holes facing a second wall part corresponding to the second end cylinder in the block inner peripheral wall, the two second through holes being formed at two locations of the upper peripheral wall facing each other in the width direction, and the coolant inlet is provided at a position shifted to a first end side in the cylinder row direction from the two first through holes.

4. The engine cooling structure according to claim 1, wherein the cylinder block includes a coolant exit provided at a position facing the lower peripheral wall, the coolant exit being configured to lead the coolant in the water jacket outside the cylinder block, and the coolant exit is connected to a heat exchanger provided outside the engine body.

5. The engine cooling structure according to claim 4, wherein the coolant exit includes a first exit and a second exit provided at positions different from each other in a circumferential direction of the lower peripheral wall, and the first exit and the second exit are respectively connected to different heat exchangers.

6. The engine cooling structure according to claim 5, wherein the heat exchanger connected to the first exit includes an oil cooler configured to cool a lubricant to be supplied to the engine body, and the heat exchanger connected to the second exit includes an EGR cooler configured to cool an EGR gas that is an exhaust gas recirculated to an intake air to be introduced into the engine body out of an exhaust gas discharged from the engine body.

7. The engine cooling structure according to claim 1, wherein when one of the plurality of cylinders at the first end of the cylinder row is a first end cylinder, the coolant inlet faces a region that is one region of a wall part corresponding to the first end cylinder in the block inner peripheral wall, the region being shifted to a first end side from a central part of the cylinder row direction of the wall part, and out of a plurality of regions obtained by dividing a region facing the coolant inlet in the peripheral wall by the dividing wall and the distribution wall, when a region positioned below the dividing wall and on the first end side in the cylinder row direction from the lower distribution wall is a first region and a region positioned below the dividing wall and on a second end side in the cylinder row direction from the lower distribution wall is a second region, the lower distribution wall is disposed at a position such that an area of the first region is smaller than an area of the second region.

8. The engine cooling structure according to claim 1, wherein the dividing wall and the distribution wall are formed to divide an opening area of the coolant inlet into a first inflow part, a second inflow part, a third inflow part, and a fourth inflow part when viewed from an outside of the block outer peripheral wall, the first inflow part being positioned above the dividing wall and on a first end side in the cylinder row direction from the upper distribution wall, the second inflow part being positioned above the dividing wall and on a second end side in the cylinder row direction from the upper distribution wall, the third inflow part being positioned below the dividing wall and on the first end side in the cylinder row direction from the lower distribution wall, the fourth inflow part being positioned below the dividing wall and on the second end side in the cylinder row direction from the lower distribution wall, the water jacket includes, between the lower peripheral wall and the block outer peripheral wall, a first lower passage through which the coolant introduced from the third inflow part flows and a second lower passage through which the coolant introduced from the fourth inflow part flows, the cylinder block includes a first coolant exit configured to lead the coolant in the first lower passage outside the cylinder block, and a second coolant exit configured to lead the coolant in the second lower passage outside the cylinder block, the first coolant exit is connected to a first heat exchanger provided outside the engine body, and the second coolant exit is connected to a second heat exchanger different from the first heat exchanger.

9. The engine cooling structure according to claim 8, wherein an area of each of the first inflow part and the second inflow part is larger than an area of either of the third inflow part and the fourth inflow part.

10. The engine cooling structure according to claim 9, wherein the first heat exchanger includes an oil cooler;

the second heat exchanger includes an EGR cooler; and an area of the third inflow part is smaller than an area of the fourth inflow part.

11. The engine cooling structure according to claim 10, wherein the upper distribution wall extends upward from the dividing wall to an upper end of the peripheral wall.

12. The engine cooling structure according to claim 9, wherein an area of the first inflow part and an area of the second inflow part are set to be approximately equal to each other.

* * * * *